US008872438B2

(12) United States Patent
Zhou et al.

(10) Patent No.: US 8,872,438 B2
(45) Date of Patent: Oct. 28, 2014

(54) LED LIGHT DIMMING WITH A TARGET BRIGHTNESS

(76) Inventors: Xunwei Zhou, Milpitas, CA (US); Yue Ji, Hangzhou (CN)

( * ) Notice: Subject to any disclaimer, the term of this patent is extended or adjusted under 35 U.S.C. 154(b) by 189 days.

(21) Appl. No.: 13/517,613

(22) Filed: Jun. 14, 2012

(65) Prior Publication Data

US 2013/0334980 A1 Dec. 19, 2013

(51) Int. Cl.
*H05B 37/02* (2006.01)
*G05F 1/00* (2006.01)

(52) U.S. Cl.
USPC ..... 315/250; 315/193; 315/307; 315/291; 323/273

(58) Field of Classification Search
CPC ..... H05B 37/02; G05F 1/00
USPC ..... 315/250, 193, 307, 185 R, 246; 323/273
See application file for complete search history.

(56) References Cited

U.S. PATENT DOCUMENTS

| | | | | |
|---|---|---|---|---|
| 5,621,283 | A | 4/1997 | Watson et al. | |
| 6,987,787 | B1 | 1/2006 | Mick | |
| 7,919,934 | B2 | 4/2011 | Lin | |
| 8,044,608 | B2 | 10/2011 | Kuo et al. | |
| 2007/0182347 | A1* | 8/2007 | Shteynberg et al. | 315/312 |
| 2010/0148681 | A1* | 6/2010 | Kuo et al. | 315/193 |
| 2011/0080110 | A1* | 4/2011 | Nuhfer et al. | 315/291 |
| 2011/0227496 | A1* | 9/2011 | Lin et al. | 315/209 R |
| 2011/0248640 | A1* | 10/2011 | Welten | 315/210 |
| 2013/0141018 | A1* | 6/2013 | Kamii | 315/360 |
| 2013/0264954 | A1* | 10/2013 | Chung et al. | 315/186 |

OTHER PUBLICATIONS

Author: Texas Instruments, Title : LM 3642 Synchronous Boost LED Flash Driver w/ High-Side Current Source , Oct. 1997.*

* cited by examiner

*Primary Examiner* — Douglas W Owens
*Assistant Examiner* — Wei Chan
(74) *Attorney, Agent, or Firm* — Kunzler Law Group, PC

(57) ABSTRACT

A system and method for dimming an LED lighting installation using an AC power source are disclosed. The disclosed LED lighting system includes an LED light having one or more LEDs, a dimming control module for controlling and adjusting brightness level of the LED light toward a desired target brightness, and a user-operated lighting control device including a power on/off switch and a dimmer. The power on/off switch passes or interrupts the AC power fed into the dimming control module. A series of turned-off operations of the power on/off switch of transitory duration causes LED light target brightness levels to be progressively increasing or decreasing leading to a desired target brightness. Operations of the dimmer result in a target brightness setting signal being generated for the dimming control module, representative of a desired target brightness as well.

20 Claims, 17 Drawing Sheets

Note: Power SW State: 0=Power-off; 1=Power-on

Note: Power SW State: 0=Power-off; 1=Power-on

Note: Power SW State: 0=Power-off; 1=Power-on

Note: Power SW State: 0=Power-off; 1=Power-on

Note: Power SW State: 0=Power-off; 1=Power-on

Note: Power SW State: 0=Power-off; 1=Power-on

LED LIGHT DIMMING WITH A TARGET BRIGHTNESS

BACKGROUND

1. Field

The subject matter disclosed herein relates generally to light intensity control of lighting systems, and more particularly to light intensity control of light emitting diode ("LED") lighting systems.

2. Description of the Related Art

Dimming of an LED light is generally subject to inefficiency, total harmonic distortion ("THD"), and electromagnetic interference ("EMI").

BRIEF SUMMARY

A system for LED light dimming in a typical LED lighting installation is disclosed. The system includes an LED light using one or more LEDs, a dimming control module connectable to the LED light used to illuminate the LED light according to a target brightness level setting, an alternating current ("AC") power source that can feed the dimming control module, and a lighting control device placed between the AC power source and the dimming control module including a manually-operated power on/off switch and a dimmer. The power on/off switch is used to pass or interrupt AC power supplied by the AC power source to the dimming control module. The dimmer is configured to generate a target brightness setting signal for the dimming control module, representative of a desired target brightness level. The dimming control module sets a number of progressively and gradually varying target brightness levels leading to attainment of a desired target brightness level based on a user input that comes either from a series of momentary turned-off operations of the power on/off switch of transitory duration or from operations of the dimmer leading to the generation of said target brightness setting signal.

A method of the present invention is also presented for LED light dimming. The method in the disclosed embodiments substantially includes the steps necessary to carry out the functions presented above with respect to the operation of the system. The method includes providing a user-operated lighting control device that includes a power on/off switch that can turn on and off an AC power to the LED light and a dimmer that can generate a target brightness setting signal, representative of a target brightness level desired by the user, receiving the AC power through the power on/off switch by the LED light, setting a number of progressively and gradually varying target brightness levels leading to attainment of a desired target brightness level by the LED light in response to a user input that comes in the form of either a series of turned-off operations of the power on/off switch of transitory duration or operations of the dimmer leading to generation of said target brightness setting signal, generating a pulse width modulated ("PWM") drive signal based on a selected target brightness level, and supplying current through the LEDs included in the LED light in response to the PWM drive signal during the reception of the AC power.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Figure 1A:
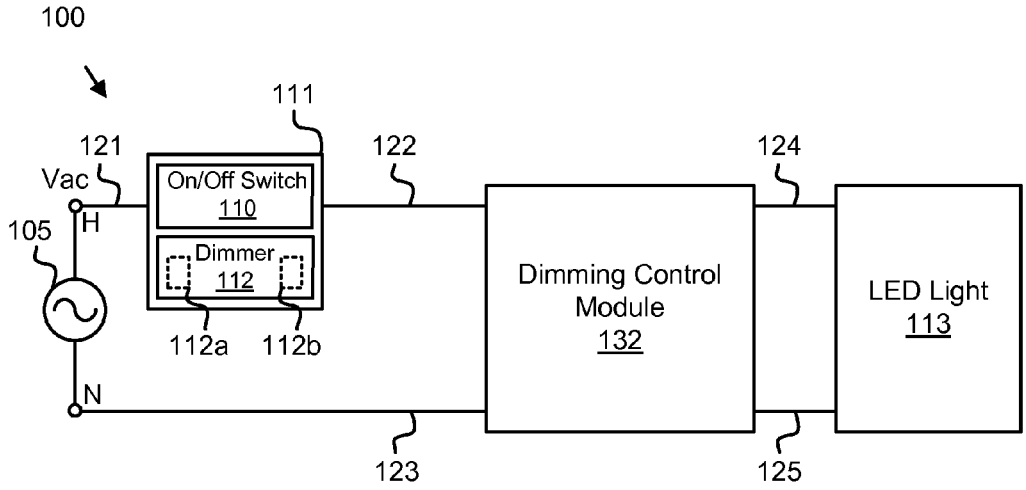
FIG. 1*a* is a schematic block diagram illustrating one embodiment of an LED lighting system in an overview form in accordance with the present invention.

References throughout this specification to features, advantages, or similar language do not imply that all of the features and advantages may be realized in any single embodiment. Rather, language referring to the features and advantages is understood to mean that a specific feature, advantage, or characteristic is included in at least one embodiment. Thus, discussion of the features and advantages, and similar language, throughout this specification may, but do not necessarily, refer to the same embodiment.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims, or may be learned by the practice of embodiments as set forth hereinafter. As will be appreciated by one skilled in the art, aspects of the present invention may be embodied as a system, method, and/or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the present invention may take the form of a computer program product embodied in one or more computer readable medium(s) having computer readable program code embodied thereon.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

The term "circuit" means at least either a single component or a multiplicity of components, either active and/or passive, that are coupled together to provide a desired function or functions. The term "signal" means at least one current, voltage, charge, temperature, data, or other signal. A signal may be used to communicate using active high, active low, time multiplexed, synchronous, asynchronous, differential, single-ended, or any other digital or analog signaling or modulation techniques.

References in the singular are made merely for clarity of reading and include plural references unless plural references are specifically excluded. Further, references to groups of elements (for example, LED strings 241-24*m*) in collective relation to other groups of elements are made merely for clarity of reading. Such references refer to the relationships of each element of the first group to each respective element of a second group unless specifically indicated otherwise. Likewise, references directed to a group may also include individual reference to each element of the group.

Computer readable program code for carrying out operations for aspects of the present invention may be written in any combination of one or more programming languages, including an object oriented programming language such as Java, Smalltalk, C++, PHP or the like and conventional procedural programming languages, such as the "C" programming language or similar programming languages.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and computer program products according to embodiments of the invention. It will be understood that each block of the schematic flowchart diagrams and/or schematic block diagrams, and combinations of blocks in the schematic flowchart diagrams and/or schematic block diagrams, can be implemented by computer readable program code. The computer readable program code may be provided to a processor of a general purpose computer, special purpose computer, sequencer, microcontroller, or other programmable data processing apparatus to produce a machine, such that the instructions, which execute via the processor of the computer or other programmable data processing apparatus, create means for implementing the functions/acts specified in the schematic flowchart diagrams and/or schematic block diagram block or blocks.

The schematic flowchart diagrams and/or schematic block diagrams in the Figures (also referred to as FIGs) illustrate the architecture, functionality, and operation of possible implementations of apparatuses, systems, methods and computer program products according to various embodiments of the present invention. In this regard, each block in the schematic flowchart diagrams and/or schematic block diagrams may represent a module, segment, or portion of code, which comprises one or more executable instructions of the program code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and computer readable program code.

FIG. 1*a* is a schematic block diagram illustrating one embodiment of an LED lighting system 100 in an overview form in accordance with the present invention. The LED lighting system 100 is typically installed in a facility utilizing an LED light in place of a conventional lighting device such as incandescent lamp, fluorescent lamp, or halogen lamp, without requiring infrastructure change. The LED lighting system 100 includes an alternating-current ("AC") power source 105, a power switch 111, a dimming control module 132, and an LED light 113 comprising a number of LEDs. In one embodiment, the AC power source 105 may be a public utility, for example, having a voltage Vac generally in the range of 120-240 volts. The two commonly used frequencies are 50 Hz and 60 Hz. In an alternate embodiment, Vac may be smaller, depending on the power requirement of the LED light 113 and implementation of the system.

In the disclosed embodiment, the assembly of the power switch 111 in an exterior view includes two manually-operated controls: one is an on/off switch 110 (single pole single throw type) for passing or interrupting power from the AC power source 105 to a load, and the other is a dimmer 112 for signaling to the dimming control module 132 a user desired target brightness level for the LED light 113 to output. Although popularly named, the power switch 111 may be more appropriated called lighting control device. This assembly may be mountable on a wall. Both the on/off switch 110 and the dimmer 112 operate in conjunction with the dimming control module 132 to effect dimming of the LED light 113 in special ways to be described below. The on/off switch 110 and the dimmer 112 are not limited to any specific form, and may take on any suitable design that allows efficient manual actuation by a user. Both said controls may be directly wired into the control circuitry of the dimming control module 132. In a certain embodiment, the panel of the power switch 111 may have an LED display (not shown) indicating the on state of the on/off switch 110, and a number of brightness level selections made one at a time by operating the dimmer 112.

The on/off switch 110 has the ability to separately and independently control the "on" state and "off" state of the power switch 111 that enables and disables the passing of the AC power source 105 to the dimming control module 132 as a result of a manual operation, respectively. Unlike most dimmers available in the industry, the dimmer 112 being operated on does not cause the amount of the AC power to be passed on by the on/off switch 110 to the load to be altered. Hereinafter, when the power switch 111 is said to be turned on or off, it means that the on/off switch 110 is activated or deactivated, respectively. In general, where the terms "power-on" and "power-off" are used, the power switch 111 is assumed to be turned-on and turned-off, respectively, by means of the on/off switch 110.

Figure 4A:
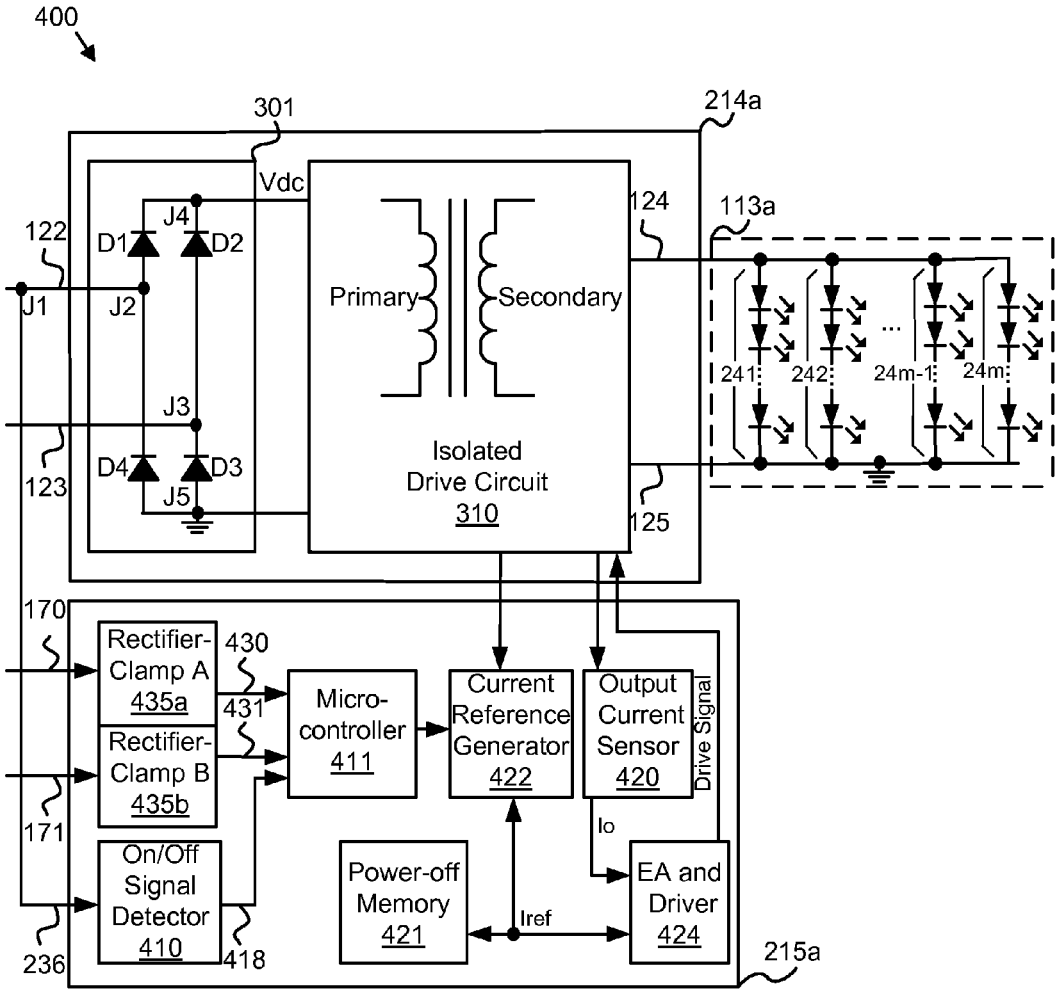
FIG. 4*a* is a schematic block diagram illustrating one embodiment of a structure of the dimming and control circuit shown in FIG. 2*a* and interface thereof with the power switching circuit shown in FIG. 3*a* in accordance with the present invention.
Figure 4B:
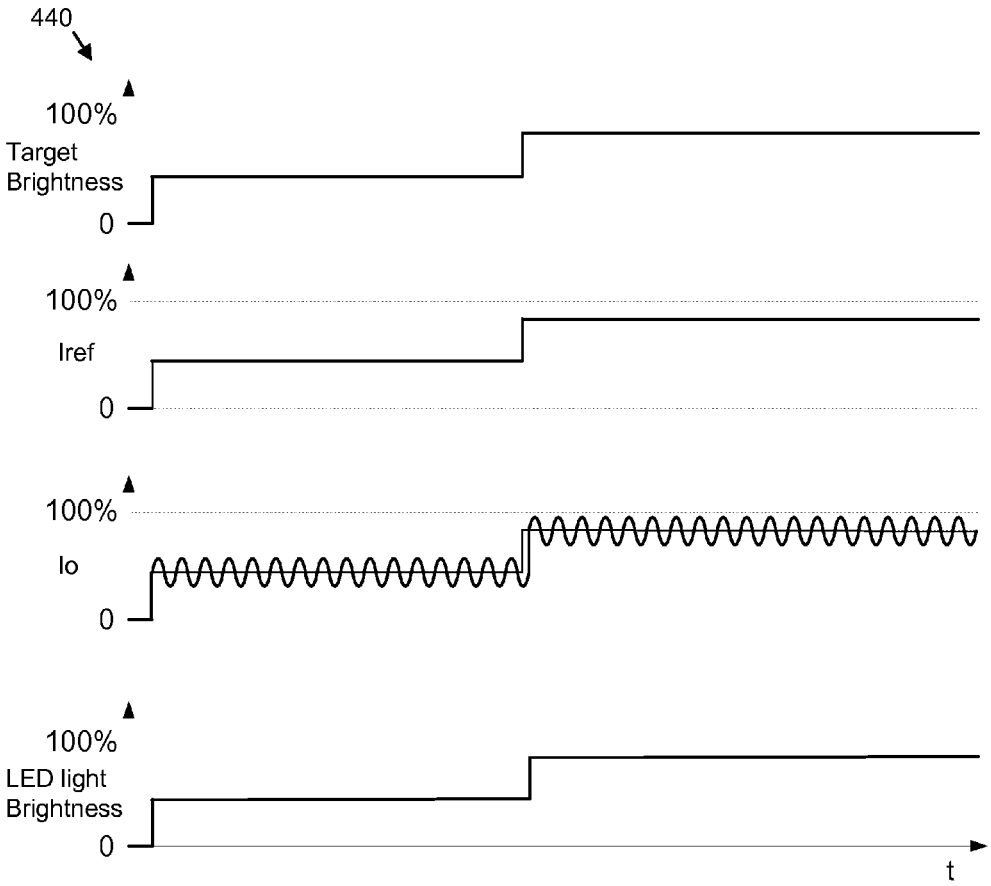
FIG. 4*b* is a time chart illustrating one embodiment of exemplary signal waveforms for dimming of the LED light shown in FIG. 4*a* in accordance with the present invention.
Figure 4C:
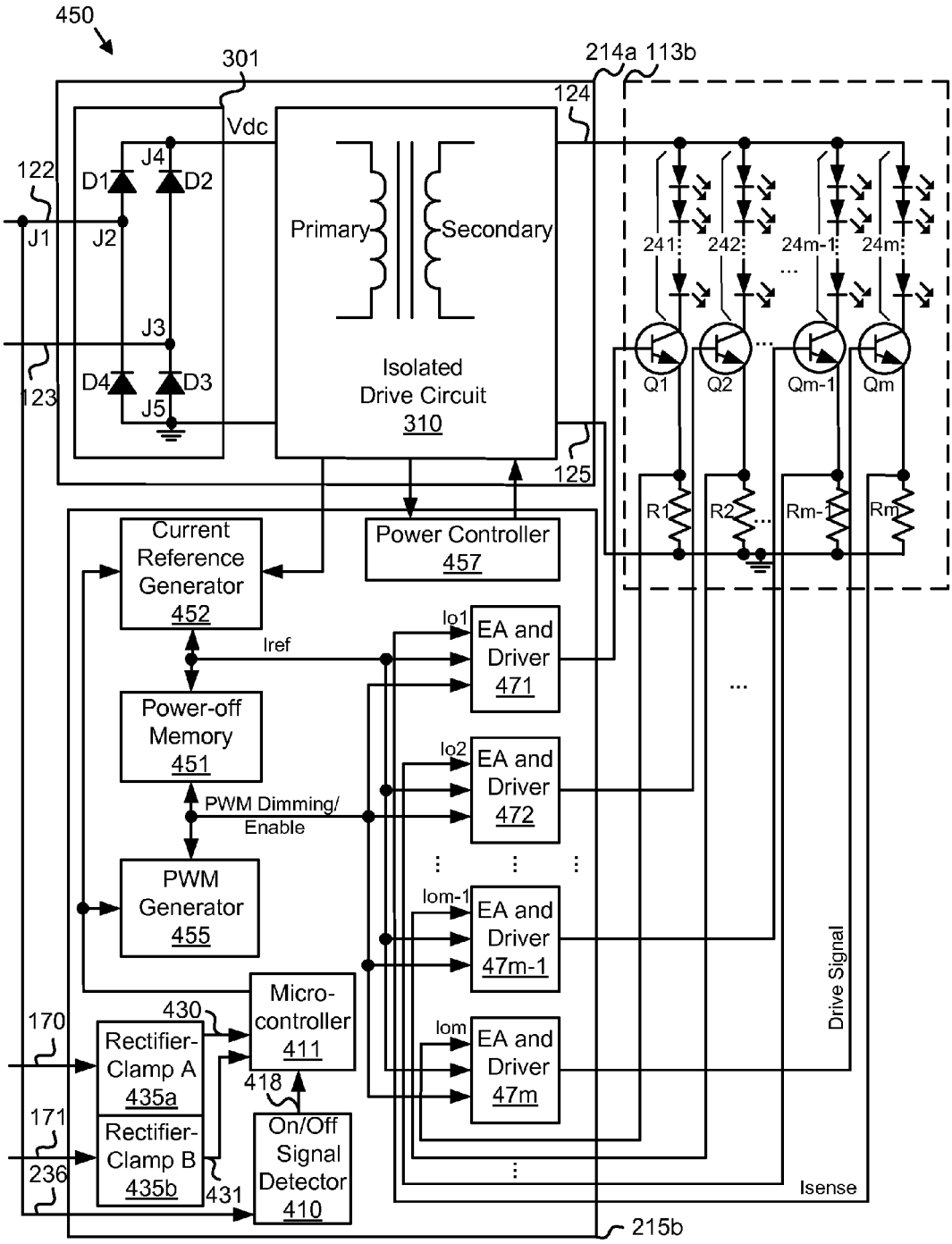
FIG. 4*c* is a schematic block diagram illustrating one embodiment of a structure of the dimming and control circuit shown in FIG. 2*b* and interface thereof with the power switching circuit shown in FIG. 3*a* in accordance with the present invention.

The dimmer 112 provides versatile brightness level control which is operated by a pair of non-latching switches 112*a* and 112*b*, which provide inputs to a microcontroller 411 in the dimming control module 132, as illustrated in FIGS. 4*a* and 4*c*. The switches 112*a* and 112*b* may be arranged as upper and lower switches on a rocker panel or, as depicted, as independent pair of panels which are normally biased to remain in a neutral position. The switches 112*a* and 112*b* are each connected in series with the AC power line, so that when either switch is depressed, a series of sequential pulses may be provided to the microcontroller 411. Typically, operations of either of switches 112*a* and 112*b* are carried out when the on/off switch 110 is placed in an off state.

Operation of the dimmer 112 either increases or decreases a target brightness level for the LED light 113 to reach during subsequent power-on time depending on whether the switch 112*a* or the switch 112*b* is depressed. Thus, these two switches are referred to as "up" switch 112*a* and "down" switch 112*b*, respectively. When the dimmer 112 is operated in either the up or down direction, the microcontroller 411 first determines whether the depression of the switch 112*a* or 112*b* is momentary, that is, a brief tap, or whether it is being held down for a period of more than transitory duration. When the switch is held, the microcontroller 411 gradually advances the target brightness level in the direction indicated by the switch, that is, towards increasing or towards decreasing; when the switch is subsequently released, the microcontroller 411 saves the final current target brightness level as a "preset" level in memory. Subsequently, the on/off switch 110 needs to be operated to turn the power on. If the dimmer 112 is first tapped in either direction with the target brightness at some static level, the microcontroller 411 will cause the target brightness level to automatically advance or decline towards a predetermined level. In general, the maximum brightness level is 100% and the minimum level is 0%. Note that in a preferred embodiment, use of the dimmer 112 indicates that an analog control scheme is put to practice for dimming the LED light 113, whereas the on/off switch 110 may be operated during dimming operations with a digital control scheme as well as with the analog control scheme, both schemes to be described in ensuing sections. The actual use of the dimmer 112 is described when dimming operations with the analog control scheme are discussed whereas the use of the on/off switch 110 to turn the power switch 111 on or off is described for both the digital and analog control schemes throughout this specification.

As shown, the power switch's 111 input terminal is connected to the first terminal marked "H" (hot terminal) of the AC power source 105 through conductor 121, and its output terminal is connected to the first input terminal of the dimming control module 132 through conductor 122. When the on/off switch 110 included in the power switch 111 assembly is in an "off" (open or turned-off) position, the switch's two terminals are not connected to each other, and, as such, the AC power is not supplied to other components in the LED lighting system 100, and no current flows through the LEDs. When the power is turned off, the LED light 113 will also fade off. When the on/off switch 110 is placed in an "on" (closed or turned-on) position, the switch's two terminals are connected together and conductors 121 and 122 are electrically connected to each other through the switch, causing the AC power to be transferred to the connected circuit. An AC voltage Vac is then present across conductors 122 and 123, which are connected to the first input terminal and the second input terminal of the dimming control module 132, respectively, where the other end of conductor 123 is connected to the second terminal marked "N" (neutral terminal) of the AC power source 105. The LED light 113 may then be turned on through the dimming control module 132. A subsequent turn-off operation of the power switch 111 by turning off the on/off switch 110 will shut off said AC power supply, and the brightness level of the LED light 113 will fade to zero, as a result.

Dimming functions provided for an incandescent lamp or fluorescent lamp in the facility are voltage-controlled, and so are not applicable to the LED light 113 because LEDs included therein are current-controlled. Therefore, a dimming function for the LED light 113 needs to be specially designed, and it needs to provide adjustability for multiple LED light 113 brightness levels to meet the user's requirements. With the dimming control module 132 designed to function in conjunction with operations of the power switch 111, the output of the LED light 113 may be adjusted for a desired target brightness level by the user conveniently and effectively. In a certain embodiment, the dimming control module 132 may include a power-off memory that remembers a last target brightness level and/or the change direction (up or down) of the last target brightness level at the instant the power switch 111 is turned off. Details of inner workings of the dimming control module 132 are provided in following sections. The structure of the LED light 113 described herein takes on two embodiments, and as such, an LED light 113*a* and an LED light 113*b* shown in FIG. 2*a* and FIG. 2*b*, respectively, are referred to and described in detail in following sections.

Those skilled in the art are familiar with the concept of generating an LED light dimming signal merely based on power-off times, namely one or more turn-off operations of a switch like the on/off switch 110, to accomplish dimming of a similar LED light. In one embodiment, the present invention provides a method based on which the LED light 113 dimming control is effected by successive turning off operations of the on/off switch 110 of the power switch 111 for transitory duration, which falls within a range defined for a typical LED lighting system, to progressively increase or decrease target brightness levels in a cyclic pattern, or using the dimmer 112 of the power switch 111 to gradually increase or decrease the target brightness to establish and maintain a preset desired target brightness level. Correspondingly, a digital dimming control scheme and an analog dimming control scheme are provided through the dimming control module 132 in conjunction with the use of the power switch 111 to generate a dimming (that is, brightness level control) signal and supply current to the LED light 113 accordingly. This method, without requiring phase cutting, can cause a sine waveform of the input current to the LEDs to be maintained and allow the input voltage to be in phase with the input current, thereby increasing the power factor associated with the input current, decreasing THD and minimizing EMI. Details of this method will be given in following sections.

Figure 1B:
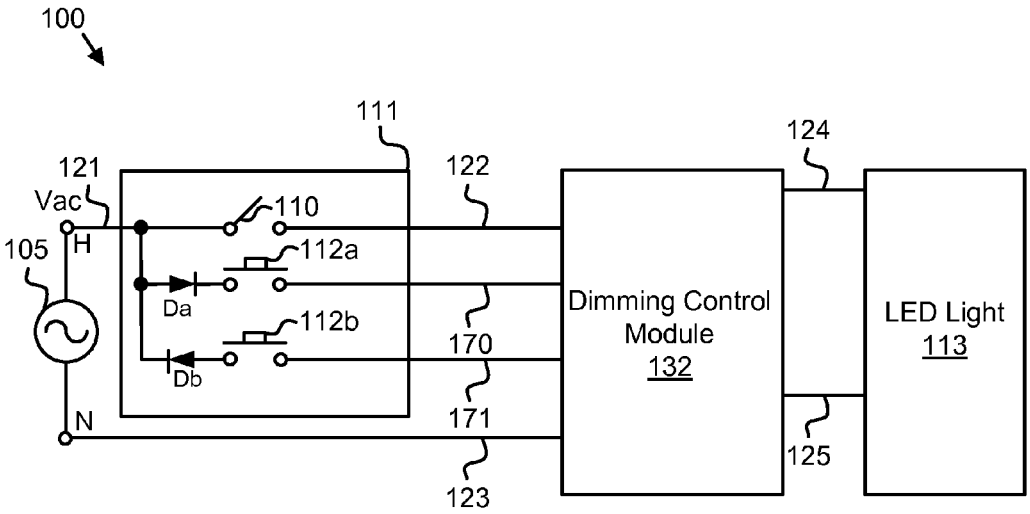
FIG. 1*b* is a schematic block diagram illustrating one embodiment of the LED lighting system including a structure and circuits of the power switch of FIG. 1*a* in accordance with the present invention.

FIG. 1*b* is a schematic block diagram illustrating one embodiment of the LED lighting system 100 including a structure and circuits of the power switch 111 of FIG. 1*a* in accordance with the present invention. The description of FIG. 1*b* refers to elements of FIG. 1*a*, like numbers referring to like elements. In addition to the structure and circuits, a description of inner workings of the power switch 111 is given. As depicted, the power switch 111 includes the on/off switch 110, the up switch 112*a* and the down switch 112*b*, each of which is shown in FIG. 1*a* in a functional block form. Herein, in terms of electromechanical devices, the on/off switch 110 may be a snap-action type or another type to allow it to be turned on/off momentarily or in a sustaining manner, that is, turned on/off indefinitely, and the dimmer up switch 112*a* and down switch 112*b* may be of a push-button type or another touch-sensitive type. As mentioned previously, to aid the user of this switch, an LED indicator (not shown) to indicate the on state of the switch would be useful. The on/off switch 110 is connected between the hot terminal (H) of the AC power source 105 and the first input of the dimming control module 132. Closure of the on/off switch 110 enables the AC power to be passed to the dimming control module 132 through conductor 122 for full-cycles of the AC waveform. Furthermore, closure of the on/off switch 110 causes a signal to be sent to the microcontroller 411 in the dimming control module 132 through an on/off signal detector 410 therein, so that the microcontroller 411 may be able to track user operations of the on/off switch 110 in the course of generating a dimming signal to control brightness of the LED light 113, as will be discussed in descriptions of FIGS. 4*a* and 4*c*.

The microcontroller 411 determines the time duration of closure of the on/off switch 110 in response to input from the on/off signal detector 410. When the on/off switch 110 is opened, the microcontroller 411 can also determine the time duration of the closure breaking (opening or turning-off) until the next closure of said switch. The microcontroller 411 can discriminate between a closure of the on/off switch 110 which is of only transitory duration and a closure which is of more than a transitory duration. The microcontroller 411 is also able to determine when the on/off switch 110 is transitorily opened a plurality of times in succession. Further discussion of operations of the power switch 111 in terms of closures and openings of the on/off switch 110 will be carried out when dimming control schemes are described.

Both the up switch 112*a* and the down switch 112*b* are non-latching switches. As illustrated, these switches are wired in line with the AC power source hot line through diodes Da and Db, respectively, to their input terminals. The out terminals of the up switch 112*a* and the down switch 112*b* are connected to a third and fourth input terminals of the dimming control module 132 through conductors 170 and 171, respectively. As the anode of diode Da and the cathode of diode Db are connected to the hot terminal H of the AC power source, only the positive half-cycles of the AC waveform are passed through the up switch 112*a* and the negative half-cycles of the AC waveform are passed through the down switch 112*b*. Each switch requires an individual rectifier and clamp circuit, which provides appropriate half-wave rectification and voltage clamping. As shown in FIGS. 4*a* and 4*c*, rectifier-clamp A 435*a* circuit and rectifier-clamp B 435*b* circuit are provided for these purposes at the front end of the dimming control module's 132 component circuit 215*a* or 215*b* shown in FIGS. 4*a* and 4*c*, respectively. The outputs of these two rectifier-clamp circuits are connected to two special input terminals of the microcontroller 411 as shown in said figures.

The input of the microcontroller 411 from either rectifier-clamp A or B 435*a* or 435*b* is responsive to a series of sequential square wave pulses. These pulses are developed from the AC line inputs through either the up switch 112*a* or the down switch 112*b* during its depression. For example, if the up switch 112*a* is depressed, the line voltage is fed to circuit A in the rectifier-clamp A 435*a* which provides half-wave rectification for the positive half-cycles of the AC waveform and clamps the voltage peaks to a level compatible with the microcontroller 411 inputs (approximately 5 volts). Thus, positive going square wave pulses are provided. Similarly, with the down switch 112*b* being depressed, the rectifier-clamps B 435*b* provides negative-going square wave pulses. In general, as aforementioned, depressing the up switch 112*a* causes the current target brightness level to be increased, and depressing the down switch 112*b* causes the current target brightness level to be decreased. The microcontroller 411 can distinguish between the positive-going pulses and negative-going pulses. The microcontroller 411 can also distinguish between a "tap" (a closure of transitory duration) and a "hold" (a closure of more than transitory duration) of the up switch 112*a* and the down switch 112*b*.

When either the up switch 112*a* or the down switch 112*b* is held, the microcontroller 411 first determines the current target brightness level. The microcontroller 411 then causes the target brightness level to increase for "up" operation or decrease for "down" operation in predetermined increments. As long as either switch is held "on", the target brightness level will gradually advance or decline. Each time an additional increment of brightness level is added, the microcontroller 411 replaces the current target brightness level in the memory which continues to be monitored until the switch is released. When the switch is released, the current target brightness level is saved in memory as a preset (target brightness) level. When either switch is tapped, the microcontroller 411 interrogates memory to find out if the current target brightness level is equal to the preset level. If the current target brightness level is equal to the preset level, then the target brightness is not changed. If not, the microcontroller 411 will add an increment to the current target brightness level in the direction of increasing or decreasing, depending on whether the up switch 112*a* or the down switch 112*b* is tapped. If the current target brightness is at the maximum level, for example, 100%, only a "down" switch 112*b* operation will cause the level to decline. If the current target brightness is at the minimum level, for example, 0%, only an "up" switch 112*a* operation will cause the level to rise. Herein, the structure and circuits of the power switch 111 are described and its inner workings are explained, which involve its manually-driven power on/off operations of certain durations and dimmer operations for brightness control, support circuitry functions for establishing a target brightness setting signal, representative of a desired brightness level for the LED light 113 to attain, and related microcontroller functions.

Figure 2A:
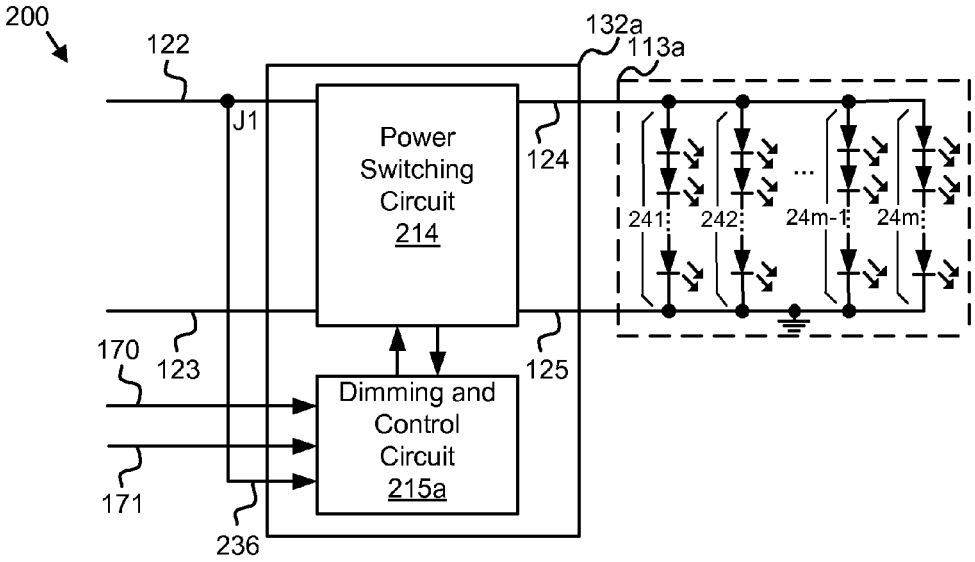
FIG. 2*a* is a schematic block diagram illustrating compositions of one embodiment of the dimming control module and one embodiment of the LED light shown in FIG. 1*b* in accordance with the present invention.

FIG. 2*a* is a schematic block diagram illustrating compositions 200 of one embodiment of the dimming control module 132 and one embodiment of the LED light 113 shown in FIG. 1*b* in accordance with the present invention. The description of FIG. 2*a* refers to elements of FIG. 1, like numbers referring to like elements. FIG. 2*a* shows main components of the LED lighting system 100 of FIG. 1*b* beyond the AC power source 105 and the power switch 111. Herein the dimming control module 132*a* and the LED light 113*a* are referenced. As depicted, the dimming control module 132*a* includes a power switching circuit 214 and a dimming and control circuit 215*a*, and the LED light 113*a* includes an array of series/parallel connected LEDs consisting of LED strings 241-24*m*.

Figure 3A:
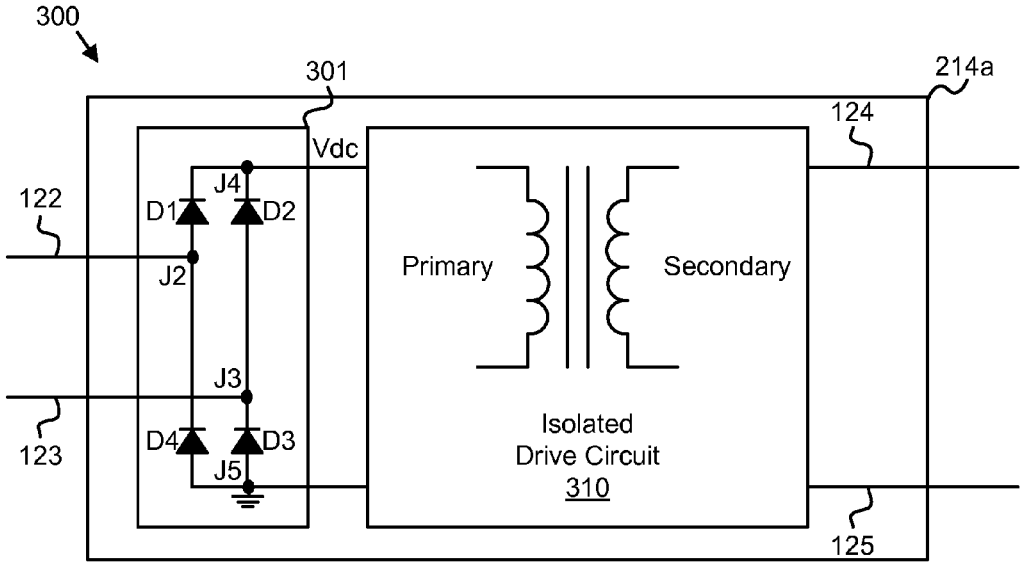
FIGS. 3*a* and 3*b* are two schematic block diagrams illustrating two alternate embodiments of a structure of the power switching circuit shown in FIGS. 2*a* and 2*b* in accordance with the present invention.
Figure 3B:
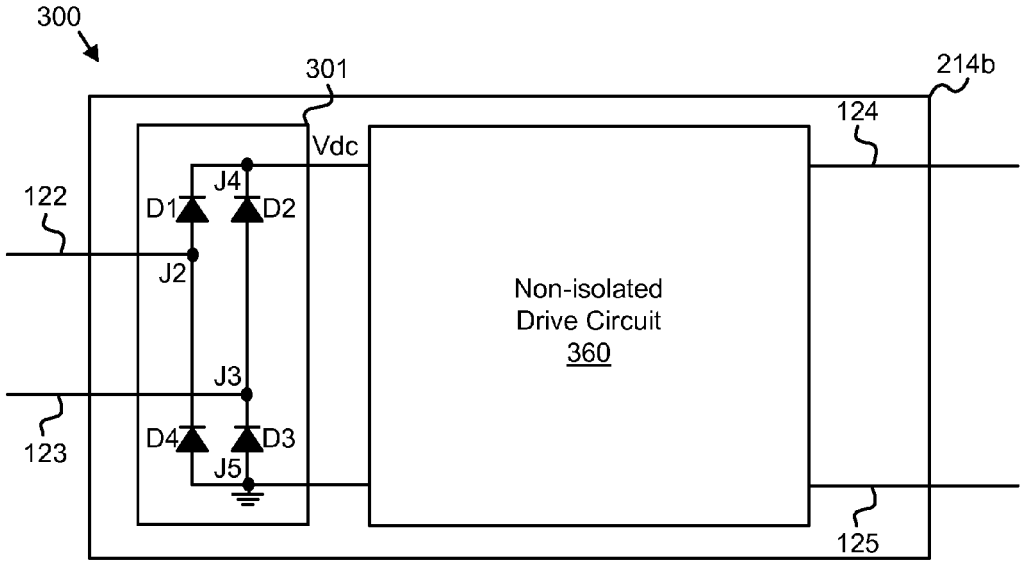

The first input terminal of the power switching circuit 214 is connected to conductor 122, which is connected to the output terminal of the power switch 111, and the second input terminal of the power switching circuit 214 is connected to conductor 123, which is connected to the second terminal (neutral) of the AC power source 105, as mentioned previously and shown in FIG. 1*b*. The first and second output terminals of the power switching circuit 214 are connected to the first and second input terminals of the LED light 113*a* by conductors 124 and 125, respectively. Two embodiments of the power switching circuit 214 structure are shown in FIG. 3*a* and FIG. 3*b*, respectively. The actual interface signals existing between the power switching circuit 214 and the dimming and control circuit 215*a* are illustrated in FIG. 4*a*. The connections between the dimming control module 132 and the power switch 111 have been described previously and are not repeated herein, except the addition that the connection between the dimming control circuit 215*a* and the on/off switch 111 is made through conductor 236, which is connected to conductor 122 at junction J1.

The dimming and control circuit 215*a* obtains and maintains target brightness setting information by monitoring the state of the power switch 111. The dimming and control circuit 215*a* monitors and controls the operation of the power switching circuit 214 so as to adjust the output current supplied to the LED light 113*a* according to a target brightness setting. Consequently, the brightness of the LED light 113*a* will be adjusted to match the target brightness. Sometime after a turn-on operation of the power switch 111, the lighting system 100 is stabilised, and the brightness of the LED light 113*a* follows the target brightness after a brief delay. When the power switch 111 is turned off, because of the shutoff of the AC power, the brightness of the LED light 113*a* declines rapidly although the dimming and control circuit 215 can sustain normal work for a while. If the dimming and control circuit 215*a* has a power-off memory to remember the current target brightness level, then the target brightness setting can be maintained for a long time after the power switch 111 is turned off.

As already mentioned, the LED light 113*a* includes multiple strings of series-connected LEDs 241, 242, . . . , 24*m*−1, and 24*m*, configured to be connected in parallel. They are also referred to collectively as loads 241-24*m* of the LED lighting system 100. In one embodiment, loads 241-24*m* may include any number of LEDs as illumination devices. Without having current limiting and/or sensing devices in any of the LED strings 241-24*m*, current in each string cannot be individually controlled. Loads 241-24*m* as a whole may be controlled to provide illumination at any of multiple target brightness levels desirable to the user. Actually, this arrangement is more suitable for a single-string LED light. Compositions 200 of the dimming control module 132*a*, which includes the power switching circuit 214 and the dimming and control circuit 215*a*, and of the LED light 113*a*, which includes multi-string series/parallel connected LEDs with no current sensing or control capability for each string, are illustrated.

Figure 2B:
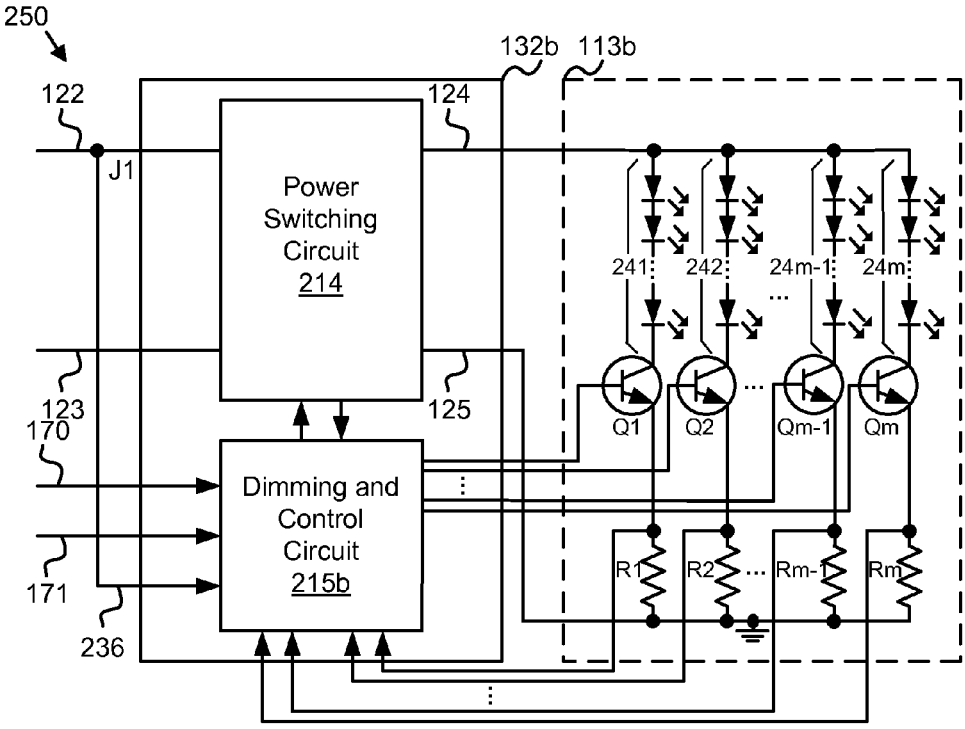
FIG. 2*b* is a schematic block diagram illustrating compositions of an alternate embodiment of the dimming control module and an alternate embodiment of the LED light shown in FIG. 1*b* in accordance with the present invention.

FIG. 2*b* is a schematic block diagram illustrating composition 250 of an alternate embodiment of the dimming control module 132 and an alternate embodiment of the LED light 113 shown in FIG. 1*b* in accordance with the present invention. The description of FIG. 2*b* refers to elements of FIGS. 1 and 2*a*, like numbers referring to like elements. Similar to FIG. 2*a*, FIG. 2*b* shows an alternate embodiment of the dimming control module 132, referred to herein as 132*b* and an alternate embodiment of the LED light 113, referred to herein as LED light 113*b*. The dimming control module 132*b* includes the power switch circuit 214 and a dimming and control circuit 215*b*. The dimming control module's 132*b* interface connections with the power switch 111 as shown are the same as those of the dimming control module 132*a*, and therefore no description of them is repeated herein. The interface between the dimming control module 132*b* and the LED light 113*b* is discussed in detail when the structure of the dimming control circuit 215*b* is presented in FIG. 4*c*. As mentioned previously, the power switching circuit 214 will be described in detail when FIGS. 3*a* and 3*b* are introduced.

The LED light 113*b* includes the LED strings 241-24*m* with a transistor Q and a resistor R connected in series in each LED string, such as Q1 and R1 in LED string 241, Q2 and R2 in LED string 242, and Qm and Rm in LED string 24*m*. Each resistor R1-Rm functions as current limiter in LED strings 241-24*m*, respectively, and each transistor Q1-Qm controls the current in each respective LED string 241-24*m* and serves to balance the current output and protect its LED string. Note that Q may be a metal-oxide-semiconductor-field-effect-transistor ("MOSFET"). To control current to loads 241-24*m*, thereby the brightness (or dimming level) of the LED light 113*b*, Q1-Qm can operate as a pulse width modulation (PWM) controller. PWM is a way of digitally encoding analog levels, resulting in reduced system cost and power consumption and increased noise immunity. PWM keeps the peak current the same but switches the output on and off quickly, thereby reducing the average current. PWM dimming is based on the persistence of vision of the human eye. Compositions 250 of the dimming control module 132*b*, which includes the power switching circuit 214 and the dimming and control circuit 215*b*, and of the LED light 113*b*, which includes multi-string series/parallel connected LEDs with in-series current sensing and limiter circuit for each string, are illustrated.

FIGS. 3*a* and 3*b* are two schematic block diagrams illustrating two alternate embodiments of a structure 300 of the power switching circuit 214 shown in FIGS. 2*a* and 2*b* in accordance with the present invention. The description of FIGS. 3*a* and 3*b* refers to elements of FIGS. 1 and 2, like numbers referring to like elements. Both the power switching circuit 214*a* in FIG. 3*a* and the power switching circuit 214*b* in FIG. 3*b* show a front-end arrangement of four diodes D1-D4 in a bridge circuit configuration that provides the same polarity of output for either polarity of input through conductors 122 and 123. In terms of voltage it is used for conversion of the AC input Vac into a direct current ("DC") output Vdc, and is known as a bridge rectifier 301. The bridge rectifier 301 provides full-wave rectification from the AC input that is the output of the AC power source 105 through the power switch 111 being turned on. In one embodiment, the bridge rectifier 301 may also contain filter(s) consisting of circuit components such as resistor, capacitor and inductor, and in a further embodiment, it may contain a voltage regulator in addition (none shown). Note that when the power switch 111 is turned off, Vdc drops to zero.

As a preferred embodiment of the power switching circuit 214 shown in FIGS. 2*a* and 2*b*, the power switching circuit 214*a* includes a bridge rectifier 301 and an isolated drive circuit 310 using a transformer, which has a primary side and a secondary side. The output of the bridge rectifier 301 is connected to an input of the isolated drive circuit 310. As an alternate embodiment of the power switching circuit 214, the power switching circuit 214*b* includes a bridge rectifier 301 and a non-isolated drive circuit 360, wherein the input is connected to the output of the bridge rectifier 301. In both embodiments, a smoothing circuit or filter (not shown) is typically placed at the output of the bridge rectifier 301 to cancel ripples and harmonics. The output of the power switch circuit 214*a* or 214*b* is connected to the LED light 113*a* or 113*b* (both not shown), respectively, through conductors 124 and 125. The power switching circuit 214*a* or 214*b* is used to control the brightness (lumen output intensity) of the LED light 113*a* or 113*b* by delivering an appropriate amount of current to the LED array (including strings 241-24*m*) thereof according to a drive signal from the dimming and control circuit 215*a* or 215*b*, respectively. As well known in the art, the brightness of the LED light 113*a* or 113*b* comprising said LED array approximately varies in direct proportion to the current supplied to said LED array. Thus, increasing current delivered to said LED array increases the brightness of the LED light 113*a* or 113*b* and decreasing current delivered thereto dims said LED light. Current can be modified by either directly reducing the direct current level to said LED array or by reducing the average current through duty cycle modulation. The latter method is generally preferred. The illustrated structure 300 of the power switching circuit 214 represents an overview of the main components of said circuit in two alternate embodiments.

FIG. 4*a* is a schematic block diagram illustrating one embodiment of a structure 400 of the dimming and control circuit 215*a* shown in FIG. 2*a* and interface thereof with the power switching circuit 214*a* shown in FIG. 3*a* in accordance with the present invention. The description of FIG. 4*a* refers to elements of FIGS. 1-3, like numbers referring to like elements. As shown, the dimming control circuit 215*a* provides control over the brightness of the LED light 113*a*, which has no in-series resistor or transistor included in each LED string 241-24*m*. The dimming and control circuit 215*a* includes the on/off signal detector 410, the rectifier-clamp A 435*a*, the rectifier-clamp B 435*b*, the microcontroller 411, a current reference generator 422, an output current sensor 420, an EA and driver 424, where EA stands for error amplifier, and a power-off memory 421, which may be an optional feature.

In one embodiment, as mentioned previously, the on/off signal detector 410 through conductor 236 connected to junction J1 of conductor 122 monitors turned-on and turned-off operations of the on/off switch 110 included in the power switch 111, which may cause the AC power from the AC power source 105 to be passed to or interrupted from the dimming control module 132*a*. When the on/off signal detector 410 detects closure of the on/off switch 110, it outputs a signal representative of the state of the switch as input to the microcontroller 411 through conductor 418. The on/off signal detector 410 can be any form of conventional circuit for detecting a switch closure and converting it to a form suitable as an input to the microcontroller 411. Those skilled in the art understand how to construct the on/off signal detector 410 without the need for a further explanation herein. In the foregoing discussion of the dimmer 112 included in the power switch 111, the functions of the rectifier-clamp A 435*a* and the rectifier-clamp B 435*b*B have been described previously and therefore are not repeated herein other than describing the relationship between its inputs and outputs. The rectifier-clamp A 435*a* circuit receives input through conductor 170 from the up switch 112*a* and outputs a signal through conductor 430 to the microcontroller 411, representing detection of closure of said switch, and likewise, the rectifier-clamp B 435*b* circuit receives input through conductor 171 from the down switch 112*b* and outputs a signal through conductor 431 to the microcontroller 411, representing detection of closure of said switch.

The microcontroller 411, in one embodiment, may be a Freescale 683xx (formerly Motorola 683xx) including a number of modules such as a central processing unit ("CPU"), a system integration module ("SIM"), a time processor unit ("TMU"), serial interface, RAM and so on, all connected by an internal bus. The TMU performs timing related tasks such as timers, counters, pulse width modulation with any duty cycle from zero to 100%, pulse width/period measurement, and pulse generation. The clock input to the counter/timers is delivered internal to the integrated microcontroller 411. Following the receipt of input through conductor 418 from the on/off signal detector 410, the microcontroller 411 keeps track of the durations of the AC power-on time duration ton and power-off time duration toff as mentioned previously and generates a dimming signal according to a digital dimming control scheme or an analog dimming control scheme, both of which are to be described in following sections. The dimming signal is transmitted to the current reference generator 422. The microcontroller 411 may also generate a dimming signal from input based on operations of the up switch 112*a* or the down switch 112*b* through the rectifier-clamp A 435*a* or the rectifier-clamp B 435*b* as described previously according to the analog dimming control scheme.

The current reference generator 422 produces a reference current signal Iref based on the dimming signal from the microcontroller 411 and a setting of the power switching circuit 214*a* and transmits the reference current signal Iref to the EA and driver 424 and the power-off memory 421. The output current sensor 420 detects the current flowing through the LED array 241-24*m* of the LED light 113*a* through the isolated drive circuit 310 of the power switching circuit 214*a*, and produces an output current feedback value Io and delivers it to the EA and driver 424. The EA and driver 424 attempts to make Io received from the output current sensor 420 and Iref received from the current reference generator 422 equal. The EA and driver 424 outputs a drive signal directed to the isolated drive circuit 310 as shown, and it supplies current to the LED array 241-24*m* accordingly.

When Io is greater than Iref, the EA and driver 424 produces a reduced drive signal, thereby decreasing the output current of the power component of the power switching circuit 214*a*, that is, decreasing the current to the LED array 241-24*m*, resulting in reduction of the output current feedback value, which tends to make Io and Iref equal. On the other hand, when Io is smaller than Iref, the EA and driver 424 produces a boosted drive signal, increasing the output current of the power component of the power switching circuit 214*a*, thereby increasing the current flowing through the LED array 241-24*m* of the LED light 113*a*, which increases the output current feedback value Io, resulting in making Io and Iref equal. The end result for the LED lighting system 100 is to make the current through the LED array 241-24*m* vary according to the reference current signal Iref. The more current to the LED array 241-24*m*, the brighter the LED light 113*a*; the less current to said array, the dimmer the LED light 113*a*.

In one embodiment, the power-off memory 421 contains non-volatile memory device such as EEPROM. Its main function is to store the current reference value Iref prior to a power-off operation of the power switch 111, so that upon next power on, Iref will be made available for use in the EA and driver 424. The illustrated structure 400 of the dimming and control circuit 215*a* and its interface with the power switching circuit 214*a* provides an insight into the building blocks of the dimming and control circuit 215*a*, inner workings of said circuit, and its working relationship with the power switching circuit 214*a* to accomplish dimming control of the LED light 113*a* in response to operations of the power switch 111.

FIG. 4*b* is a time chart illustrating one embodiment of exemplary signal waveforms 440 for dimming of the LED light 113*a* shown in FIG. 4*a* in accordance with the present invention. The description of FIG. 4*b* refers to elements of FIGS. 1-3 and 4*a*, like numbers referring to like elements. Only simplified signal waveforms such as inputs Io and Iref to the EA and driver 424 are shown herein. As mentioned previously, the output current sensor 420 in the dimming and control circuit 215*a* detects the current flowing through the LED array 241-24*m* of the LED light 113*a* through the power switching circuit 214*a*, and produces an output current feedback value Io. The current reference generator 422 in the dimming and control circuit 215*a* receives the setting of the power switching circuit 214*a* together with the dimming signal from the microcontroller 411 and produces a current reference value Iref. The EA and driver 424 attempts to make Io and Iref equal. Consequently, the current through the LED array 241-24*m* varies with the current reference value Iref. The brightness of the LED light 113*a* approximately varies in direct proportion to the current flowing through said LEDs. As depicted, Iref and the target brightness level vary in the disclosed embodiment. The brightness of the LED light 113*a* will match up to the target brightness as illustrated.

Note that measured light is the amount of light as shown on a light meter. Perceived light is the amount of light that a human eye interprets due to dilation. The eye's pupil dilates at lower brightness levels, causing the amount of perceived light to be higher than measured, for example, 20% measured equal to approximately 45% perceived. The LED light brightness levels shown herein and hereinafter in waveforms are perceived brightness levels. Also note that because the input voltage in the power switching circuit 214*a* is a sine wave, the output current (reflected on the Io waveform) has double power frequency ripples superimposed on as illustrated. For instance, if the power frequency is 50 Hz, then the output current has 100 Hz ripples. In general, the output current ripple size is inversely proportional to the output electric capacity.

FIG. 4*c* is a schematic block diagram illustrating one embodiment of a structure 450 of the dimming and control circuit 215*b* shown in FIG. 2*b* and interface thereof with the power switching circuit 214*a* shown in FIG. 3*a* in accordance with the present invention. The description of FIG. 4*c* refers to elements of FIGS. 1-3 and 4*a* and 4*b*, like numbers referring to like elements. The dimming and control circuit 215*b* provides control over the brightness of the LED light 113*b*. The dimming and control circuit 215*b* includes the on/off signal detector 410, the rectifier-clamp A 435*a* and rectifier-clamp B 435*b*, the microcontroller 411, a PWM generator 455, a current reference generator 452, a power controller 457, an EA and driver 471 for the LED string 241 with in-series transistor Q1 and resistor R1, an EA and driver 472 for the LED string 242 with in-series transistor Q2 and resistor R2, . . . , an EA and driver 47*m*−1 for the LED string 24*m*−1 with in-series transistor Qm−1 and resistor Rm−1, an EA and driver 47*m* for the LED string 24*m* with in-series transistor Qm and resistor Rm, and a power-off memory 451, which may be an optional feature. Resistors R1-Rm after sensing currents in respective LED string 241-24*m* of the LED light

113*b* send current feedback signals Iom-Io1 to EA and driver 471-47*m* as illustrated, respectively.

The description of the on/off signal detector 410, the rectifier-clamp A 435*a*, the rectifier-clamp B 435*b*, and the microcontroller 411 has been given in the foregoing description of FIGS. 1*b* and 4*a*, and so is not repeated herein. However, following the receipt of a signal through conductor 418 from the on/off signal detector 410 or a signal through conductor 430 or conductor 431 from the rectifier-clam A 435*a* or from the rectifier-clam B 435*b*, the microcontroller 411 herein internally tracks the power-on time duration ton and the power-off time duration toff and sends a dimming signal to both the current reference generator 452 and the PWM generator 455. The current reference generator 452 produces a reference current signal Iref based on the setting of the power switching circuit 214*a* alone or in conjunction with the dimming signal from the microcontroller 411, the latter option being similar to the current reference generator 422 of FIG. 4*a*.

The PWM generator 455 produces a PWM dimming/enable signal for dimming enablement, which enables (or disables) the operation of each EA and driver 471-47*m*. As mentioned previously, in general, PWM is a technique for controlling power to inertial electrical devices, made practical by modern electronic power switches. The average value of voltage (and current) fed to a load is controlled by turning the switch between supply and the load on and off at a fast pace. The longer the switch is on compared to the off periods, the higher the power supplied to the load. When the load is an LED or LEDs, PWM current control is an efficient method for driving LEDs. The PWM driver is used to dim LEDs and is based on the persistence of vision of the human eye. The current does not flow through the LEDs continuously. The PWM period is normally in the range of 100 Hz to 250 Hz. LED dimming is accomplished by changing the PWM duty cycle, which describes the proportion of 'on' time to the 'period' of the signal. The higher the PWM duty cycle, the brighter the LEDs. With a low duty cycle, the LED brightness diminishes. The LED brightness at any level is basically proportional to the PWM duty cycle.

The reference current Iref and the PWM dimming/enable signal jointly decide on the amount of average current flowing through the LED light 113*b*, which determines the brightness of the LED light 113*b*. When the PWM dimming/enable signal is in the high state ("1"), it enables each EA and driver 471-47*m* and regulates each drive signal of Q1-Qm, making each output current feedback value Io1-Iom equal to the reference current signal Iref. In one embodiment, when the current feedback value Iom of Qm is greater than the reference current Iref, EA and driver 47*m* lowers the amplitude of the drive signal to Qm and thus decreases the current of Qm, resulting in decreasing Iom. On the other hand, when the current feedback value Iom of Qm is smaller than the reference current Iref, EA and driver 47*m* raises the amplitude of the drive signal to Qm and thus increases the current of Qm, resulting in increasing Iom. The LED lighting system 100 reaches an equilibrium with the current feedback value of Q1-Qm being equal to the value of the reference current Iref. When the PWM dimming/enable signal is in the low state ("0"), each EA and driver 471-47*m* is not enabled, outputting zero potential; that is, Q1-Qm are turned off, and each LED string 241-24*m* has zero (0) current flowing through.

Consequently, the current waveform of the LED light 113*b* follows the PWM waveform; the duty cycle and cycle time of the waveform match those of the PWM dimming/enable signal inputting to the EA and driver 471-47*m*. Furthermore, when the PWM dimming/enable signal is in the high state, the current flowing through each LED string 241-24*m* has the same amplitude and matches the target current setting. In general, the target current of each LED string 241-24*m* is the largest normal work load current for the type of LEDs therein, effecting PWM dimming on the LED light 113*b* through the PWM dimming/enable signal from the PWM generator 455.

The current reference generator 452 may thus produce the reference current Iref simply based on the setting of the power switching circuit 214*a*. To accomplish dimming, the PWM dimming/enable signal may operate together with the reference current Iref. For example, for dimming the LED light 113*b*, namely decreasing the brightness thereof, both the PWM dimming/enable signal amplitude and the reference current Iref signal amplitude may be reduced. The current reference generator 452 may also produce a reference current Iref based on the dimming signal generated by the microcontroller 411 in conjunction with the setting of the power switching circuit 214*a*. When the desired brightness level is so small that it is even smaller than that resulted from the PWM dimming signal with the minimum pulse width, concurrently decreasing the reference current Iref becomes necessary to attain the desired brightness. Therefore, the dimming signal from the microcontroller 411 and the setting of the power switching circuit 214*a* need to co-operate to produce the reference current Iref.

The power controller 457 detects the state of the power switching circuit 214*a* such as the output voltage and produces a drive signal for driving a power component of the power switching circuit 214*a* for attaining a certain output (voltage) level to supply power to the attached LED array of the LED light 113*b*. The power-off memory 451 containing such memory device as EEPROM is used to save the PWM dimming/enable signal and Iref signal prior to the incidence of a power off such as set off by a turned-off operation of the power switch 111, thereby enabling the LED lighting system 100 to remember important operating parameters against a loss of power. Thus, based on the contents of the power-off memory 451, the current reference generator 452 may produce the reference current Iref. The illustrated structure 450 of the dimming and control circuit 215*b* and its interface with the power switching circuit 214*a* provides an insight into functional building blocks of the dimming and control circuit 215*b*, inner workings of said circuit and its working relationship with the power switching circuit 214*a* to accomplish dimming of the LED light 113*b* in response to operations of the power switch 111.

Figure 4D:
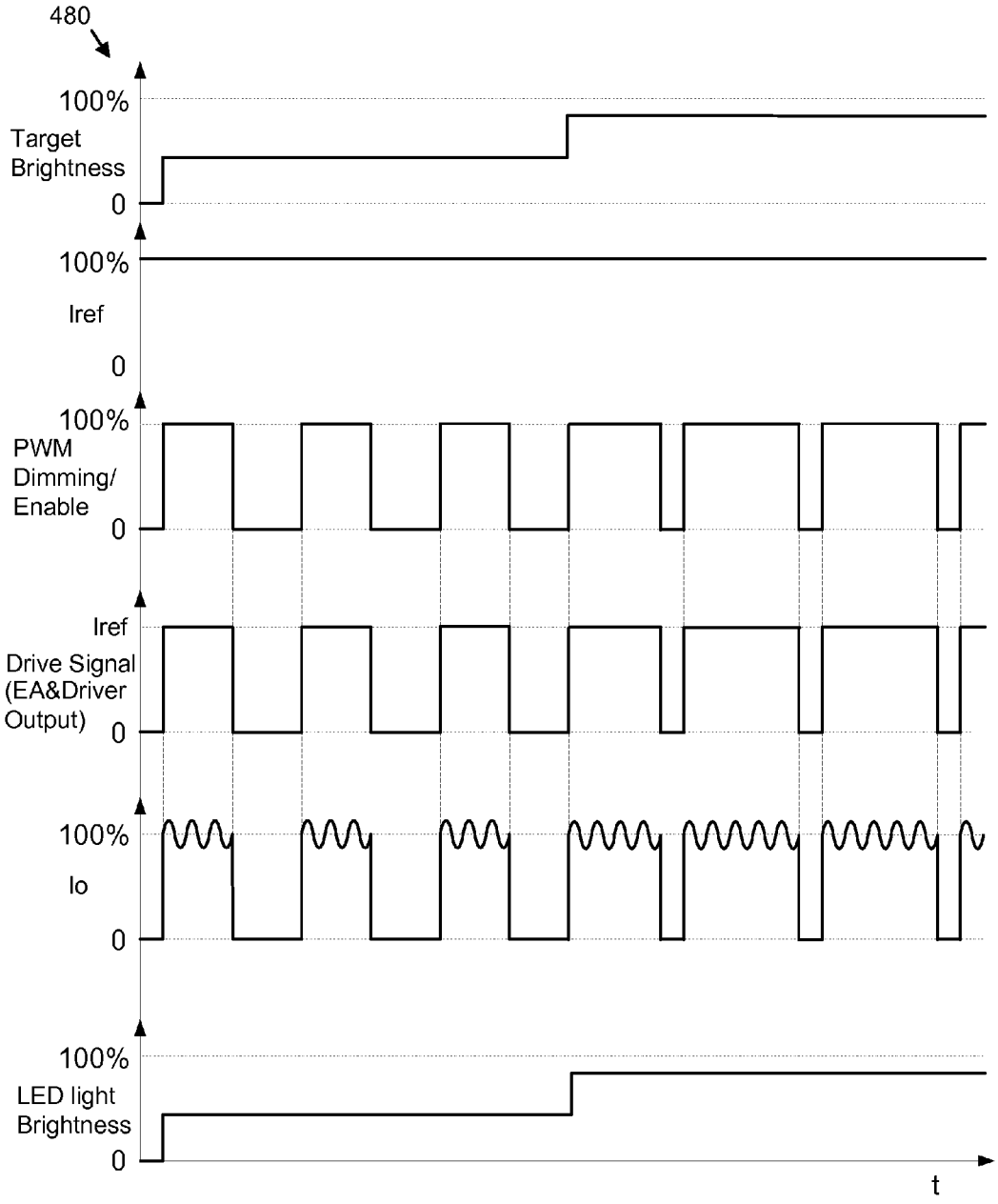
FIG. 4*d* is a time chart illustrating one embodiment of exemplary signal waveforms for dimming of the LED light shown in FIG. 4*c* in accordance with the present invention.

FIG. 4*d* is a time chart illustrating one embodiment of exemplary signal waveforms 480 for dimming of the LED light 113*b* shown in FIG. 4*c* in accordance with the present invention. The description of FIG. 4*b* refers to elements of FIGS. 1-3 and 4*a*-4*c*, like numbers referring to like elements. The relationship between the inputs and the output of one EA and drivers 47*x* for a particular LED string 24*x* including an in-series transistor Qx and a resistor Rx, where x may be any number 1 through m, is depicted herein. Iref, the output of the current reference generator 452 and Io, the feedback current from said LED string, which are the current inputs of the EA and driver 47*x*, are shown together with another input thereof, PWM dimming/enable signal, which is the output of the PWM generator 455. Also illustrated is the matching relationship between the target brightness set and the brightness of the LED light 113*b* (although only one LED string thereof is depicted). In actuality, when the target bright is changed, there is a certain amount of delay incurred before the brightness of the LED light 113*b* matches the new target brightness.

Note that for a given Iref value, the brightness outputted by the LED string 24*x* varies directly with the duty cycle of the PWM dimming/enable signal. For 100% brightness, for example, the duty cycle of the PWM dimming/enable signal is set to 100%. For 50% brightness, the duty cycle of the PWM dimming/enable signal is set to 50%. If the duty cycle of the PWM dimming/enable signal is 50% and Iref is also 50%, then the average output current to the LED string 24*x* is only 25%, resulting in 25% brightness. Also note that the situation with Io ripple current herein is the same as that explained in description of FIG. 4*b*.

Figure 5:
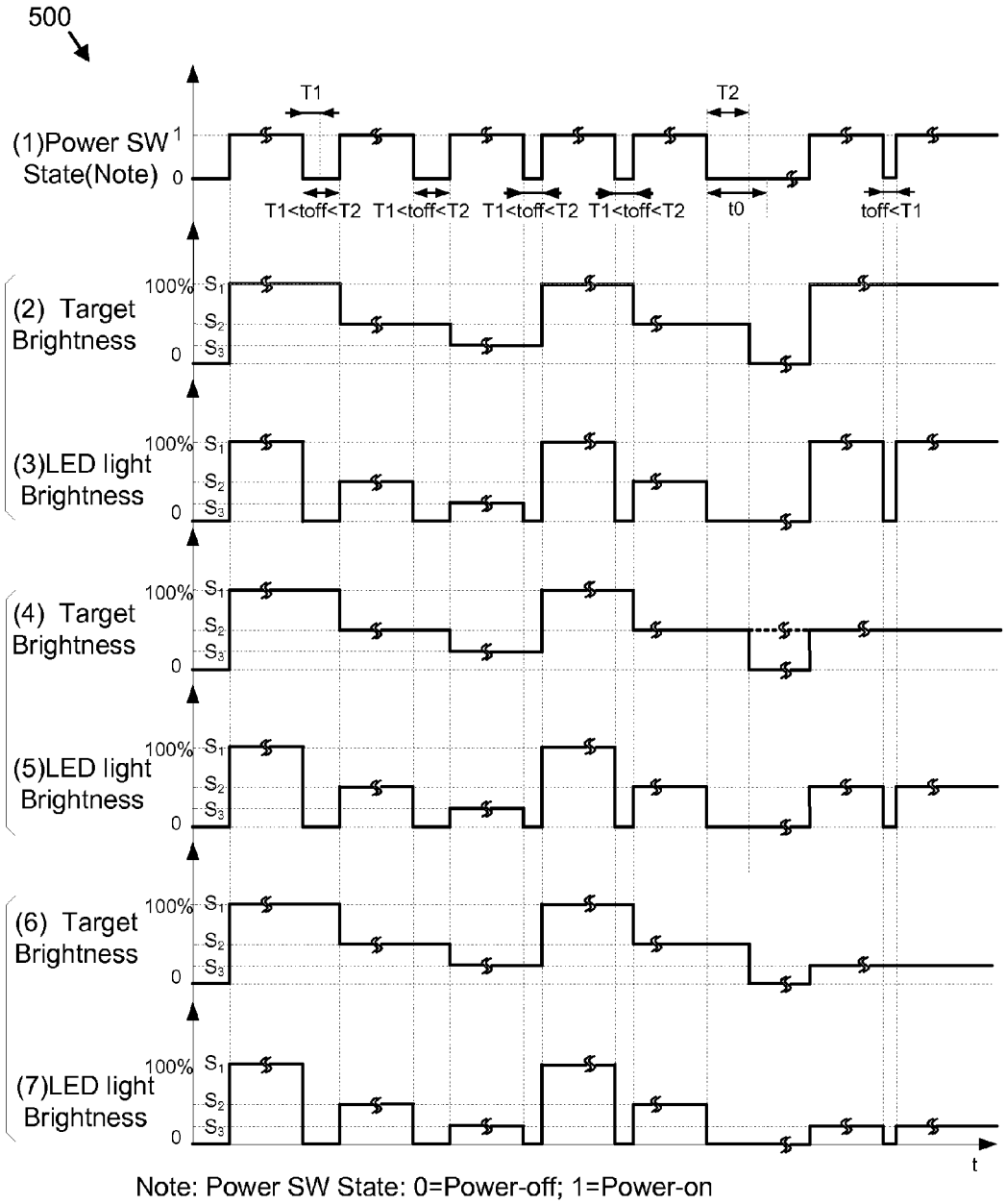
FIG. 5 is a time chart illustrating one embodiment of exemplary LED light dimming operations with a digital control scheme in a first form in accordance with the present invention.

FIG. 5 is a time chart 500 illustrating one embodiment of exemplary LED light dimming operations with a digital control scheme in a first form in accordance with the present invention. The description of FIG. 5 refers to elements of FIGS. 1-4, like numbers referring to like elements. In controlling all ensuing exemplary LED light dimming operations, the microcontroller 411 plays an important role in conjunction with the power switch 111. A series of short one-touch digital operations of the on/off switch 110 inside the power switch 111 detected may result in dimming of the LED light 113 by the dimming control module 132. In one embodiment, in terms of brightness of the LED light 113, a digital control signal may cause the brightness to discontinuously decrease by a certain percentage for each brief turned-off operation of the power switch 111 from an assumed initial full brightness level of 100%. A multiplicity of brightness level Sx (in percentage), where x may be 1, 2, . . . , or n (n may be any number), may be assigned; thus, for a three-level implementation, for example, S1, S2, and S3 are available to arbitrarily represent the brightness of the LED light 113 at 100% (1), 50% (0.5), and 30% (0.3) levels, respectively, as shown. In terms of dimming, when the brightness is 100% (S1), no dimming (0%) takes places. When the brightness is 50% (S2), a dimming of 50% of the full brightness takes places. Finally, when the brightness is 30% (S3), a dimming of 70% of the full brightness takes place. A dimming signal may reflect any of these levels at a particular time. With this digital scheme, if an initial brightness level, for example, is S1 (100%), the next lower level that it may change to is S2 (50%), and the level after that typically is S3 (30%) (although it may rise to S1 in a certain case), as illustrated at (2), which is a target brightness waveform.

In the following discussion, power-off time duration toff represents the time duration when the state of the power switch 111 is "0" (off, or open) and power-on time duration ton represents the time duration when the state of the power switch is "1" (on, or closed). As illustrated at (1), after an initial power-on operation while the power switch 111 remains on, during which the waveform of the power switch 111 is in the high state ("1"), a series of brief turned-off operations of the power switch 111 take place, when the power switch is in the low state ("0"). These operations cause each target brightness set for the LED light 113 to be progressively decreasing to the next lower level from the initial full brightness level S1 at the next power-on time, as illustrated at (2). However, after the lowest target brightness level is reached, the target brightness may progressively increase to the next higher level at the next power-on time. This kind of progression may repeat until a turned-off operation of the power switch 111 ceases to be short in time duration, when a desired target brightness level is reached at next power on time, which prevails thereafter.

As can be seen from the illustration at (2), after the first turned-off operation of the power switch 111, at the next power-on time, the target brightness decreases from S1 to S2, and after the second turned-off operation of the power switch 111, at the next power-on time, the target brightness decreases further to S3. After that, a brief turned-off operation of the power switch 111 causes the target brightness to rise to S1 at the next power-on time. Then, the previous results repeat until the power switch 111 is turned off and remains off for a longer duration, subsequent to which the full brightness S1 is restored.

The power-off time duration toff required for above discussed operations is in the range of T1 to T2, where T1 and T2 are time constants, and T2 may be equal or less than t0, t0 being the normal operating time duration in milliseconds ("ms") of the dimming and control circuit 215 during power off. The duration of t0 is related to the output electric capacity and output current of said circuit. The larger the output electric capacity, the longer said operating time duration; the smaller output current, the longer said operating time duration. In general, provision of output electric capacity is based on hold-on time required to keep the LED lighting system 100 operating normally with a full load for the time duration of t0 following the power cutoff.

The microcontroller 411 measures and checks toff to determine if toff is within the range of T1 to T2. A reasonable definition of these two time constants can be given. For example, in an LED lighting system 100, if said hold-on time required is 500 ms, T2 may be chosen to be 300 ms. T1 may be a small fraction of the half cycle time; in a 50 Hz power system, for example, T1 should be smaller than 1 ms to obtain a fair dimming accuracy. However, T1 may not be too small, otherwise interference rejectability is sacrificed. A suitable range for T1 may be 400 microseconds to 1 millisecond. Thus, in general, following a brief power-off operation of the power switch 111, at the next power-on time the target brightness Sx may be decreased to Sx+1, where x may be 1, 2, . . . n and n may be any number. If Sx is 1 (shown as S1), Sx+1 (shown as S2) may be between 1 (full brightness) and 0 (zero brightness), such as 0.5, or 0.7. If the power-off time duration toff is smaller than T1, then the target brightness does not change. If toff is greater than T2, then the target brightness may or may not be set to zero. See the illustration at (4) where a dashed line depicts the latter case.

As evident in illustrated waveforms, during power-off time, the brightness of the LED light 113 is zero (no current flowing through the LED array), and at the next power-on time its brightness matches the target brightness, where the last power-off time duration toff is in the range of T1 to T2. Three such examples are illustrated: 1. at (2) and (3); 2. at (4) and (5); and 3. at (6) and (7). When toff is greater than T2 (and t0), there are three ways to control dimming in response to such turned-off operation of the power switch 111 followed by a turned-on operation of said switch after the dimming and control circuit 215 is reset:

a. restoring the initial full brightness level S1 for the target brightness and for the brightness of the LED light 113, as illustrated at (2) and (3), respectively;
b. continuing the last brightness level for the target brightness and for the brightness of the LED light 113, as illustrated at (4) with dashed lines and (5), respectively; and
c. assuming the next lower brightness level from the last brightness for the target brightness and for the brightness of the LED light 113, as illustrated at (6) and (7), respectively.

Note that power-off memory 421 or 451 saves the last brightness level in terms of the current flowing through the LED light 113 at the instant the power switch 111 is turned off. The time chart 500 illustrates the LED light 113 dimming operations in the first form of the digital control scheme, in response to a dimming signal based on turned-off operations of the power switch 111 and the use of the power-off memory 421 or 451, with changes to the target brightness level following a cyclic pattern of progressively decreasing.

Figure 6:
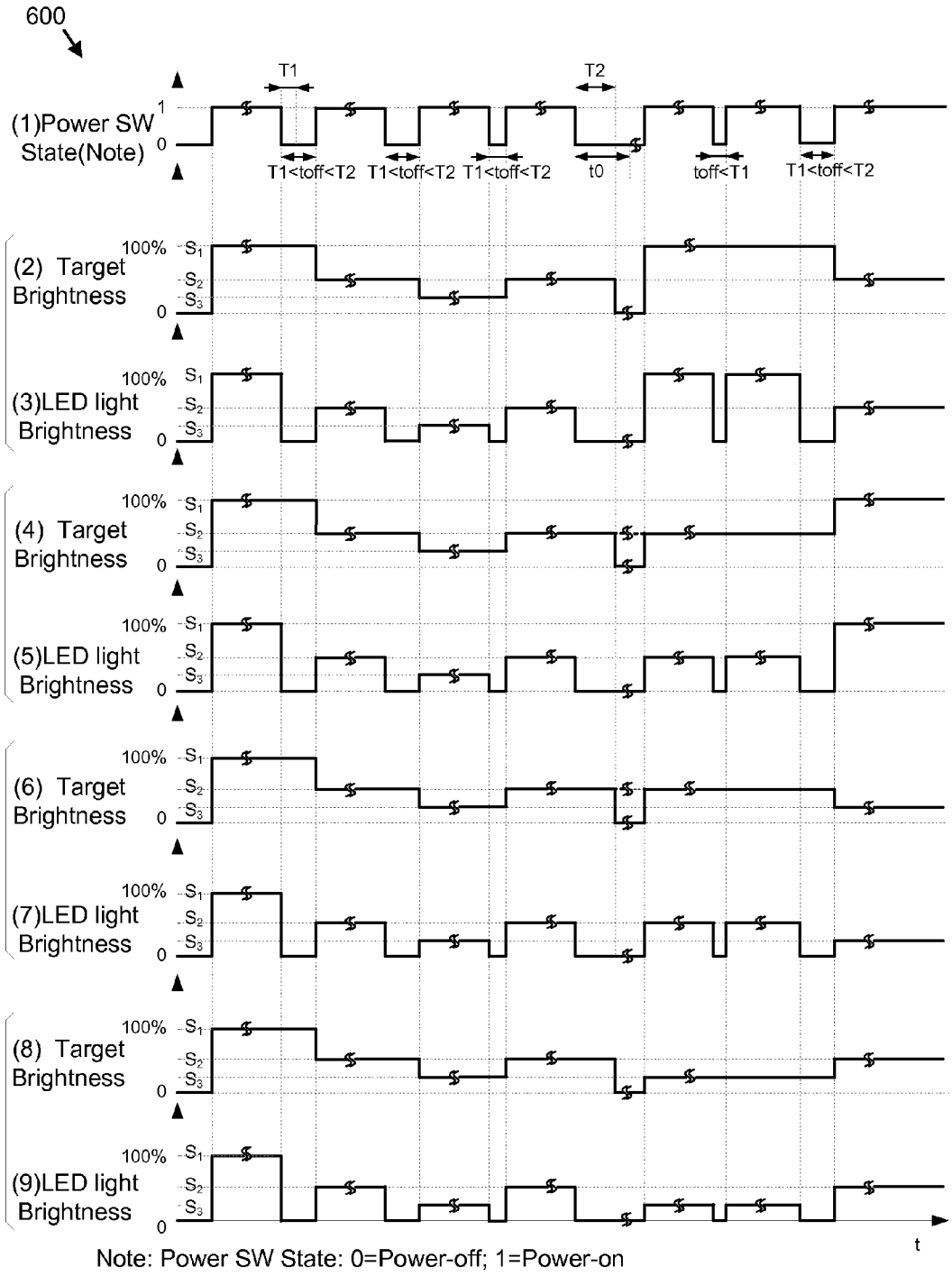
FIG. 6 is a time chart illustrating one embodiment of exemplary LED light dimming operations with the digital control scheme in a second form in accordance with the present invention.

FIG. 6 is a time chart 600 illustrating one embodiment of exemplary LED light dimming operations with the digital control scheme in a second form in accordance with the present invention. The description of FIG. 6 refers to elements of FIGS. 1-5, like numbers referring to like elements. As shown, waveforms herein are similar to those illustrated in FIG. 5, except that changes in target brightness level may now progress in a decreasing order as well as in an increasing order following turned-off operations of the power switch 111. Parts of the description of FIG. 5 also apply and are not repeated herein. When toff is greater than T2 (and t0), there are four ways to control dimming in response to such turned-off operation of the power switch 111 followed by a turned-on operation of said switch after the dimming and control circuit 215 is reset:

a. restoring the initial full brightness level S1 for the target brightness and for the brightness of the LED light 113, as illustrated at (2) and (3), respectively;
b. continuing the last brightness level for the target brightness and for the brightness of the LED light 113, as illustrated at (6) with dotted lines and (7), respectively;
c. assuming the next lower brightness level from the last brightness for the target brightness and for the brightness of the LED light 113, as illustrated at (8) and (9), respectively; and
d. continuing the last brightness level as in b, and thereafter at the next power-on time following a subsequent brief turned-off operation (T1<toff<T2) of the power switch 111, assuming the next higher (as opposed to lower in b) brightness level for the target brightness and for the brightness of the LED light 113, as illustrated at (4) and (5).

The aforementioned fourth way is made possible by the use of the power-off memory 421 or 451 to not only save the last brightness level (in terms of the current flowing through the LED light 113), but also the direction of change in brightness (up, in this case) leading to such last brightness level. The time chart 600 illustrates the LED light 113 dimming operations in the second form of the digital control scheme, in response to a series of turned-off operations of the power switch 111, with changes to the target brightness level following a cyclic pattern of progressively decreasing and then increasing.

Figure 7:
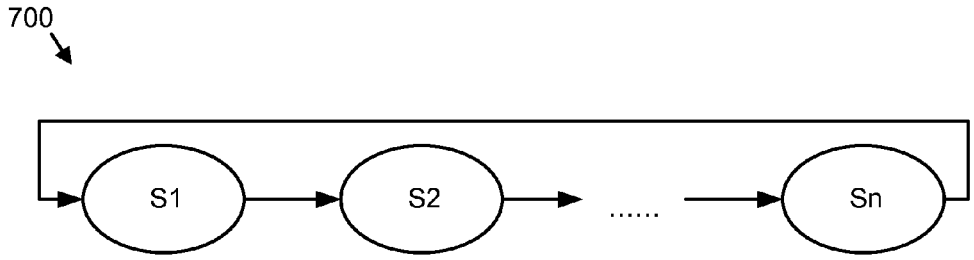
FIG. 7 is a state diagram illustrating one embodiment of a cyclic pattern for setting progressive target brightness levels used in the digital control scheme shown in FIG. 5 in accordance with the present invention.

FIG. 7 is a state diagram illustrating one embodiment of a cyclic pattern 700 for setting progressive target brightness levels used in the digital control scheme shown in FIG. 5 in accordance with the present invention. The description of FIG. 7 refers to elements of FIG. 5, like numbers referring to like elements. As shown, a target brightness level changes to the next lower brightness level in response to a brief turned-off operation of the power switch 111 followed by a turned-on operation of said switch in a cyclic pattern based on the scheme shown in FIG. 5. For the three-level brightness examples therein, target brightness levels are changed in the following progressive fashion and the pattern repeats: S1→S2→S3→S1→S2→S3 . . . , where → means "changed to". Thus, if the current target brightness level is S1, the target brightness is set to S2 in response to a brief turned-off operation of the power switch 111 followed by a turned-on operation of said switch by the microcontroller 411. When the lowest level S3 is reached, the highest level S1 is set in response to a brief turned-off operation of the power switch 111 followed by a turned-on operation of said switch, and this target brightness level change pattern repeats. A general form of the cyclic pattern 700 for n target brightness level settings is: S1→S2> . . . Sn→S1→S2 . . . Sn . . . , where n may be any number.

Figure 8:
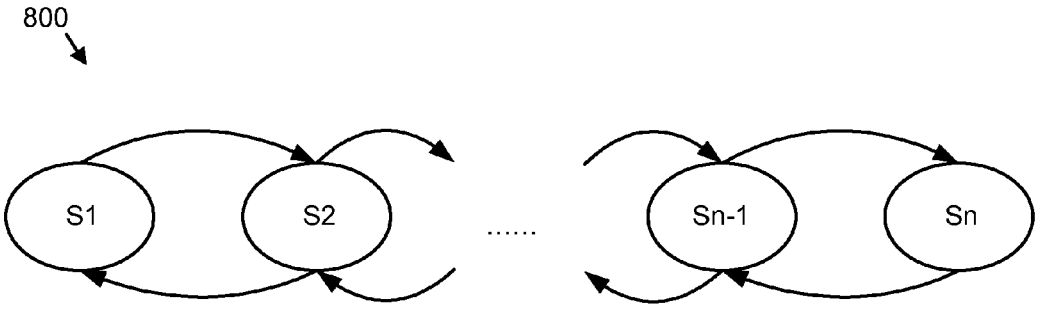
FIG. 8 is a state diagram illustrating one embodiment of a cyclic pattern for setting progressive target brightness levels used in the digital control scheme shown in FIG. 6 in accordance with the present invention.

FIG. 8 is a state diagram illustrating one embodiment of a cyclic pattern 800 for setting progressive target brightness levels used in the digital control scheme shown in FIG. 6 in accordance with the present invention. The description of FIG. 8 refers to elements of FIG. 6, like numbers referring to like elements. As shown, a target brightness level changes to the next brightness level in response to a brief turned-off operation of the power switch 111 followed by a turned-on operation of said switch in a cyclic pattern based on the digital control scheme shown in FIG. 6. For the three-level brightness examples therein, brightness levels are changed in the following progressive fashion and the pattern repeats: S1→S2→S3→S2→S1→S2→53 . . . , where → means "changed to". Thus, if the current target brightness level is S1, the target brightness is set to S2 in a forward direction in response to a brief turned-off operation of the power switch 111 followed by a turned-on operation of said switch by the microcontroller 411. When the lowest level S3 is reached, the target brightness level set in response to a subsequent brief turned-off operation of the power switch 111 followed by a turned-on operation of said switch in a backward direction begins, that is, S2 is set. This backward target brightness level change pattern continues until the highest brightness level S1 is arrived at, at which time a forward change direction is taken again. A general form of the cyclic pattern 800 for n target brightness level setting is: S1→S2→ . . . Sn−1→Sn→Sn−1→ . . . S2→S1→S2 . . . Sn−1→Sn . . . , where n may be any number.

Figure 9:
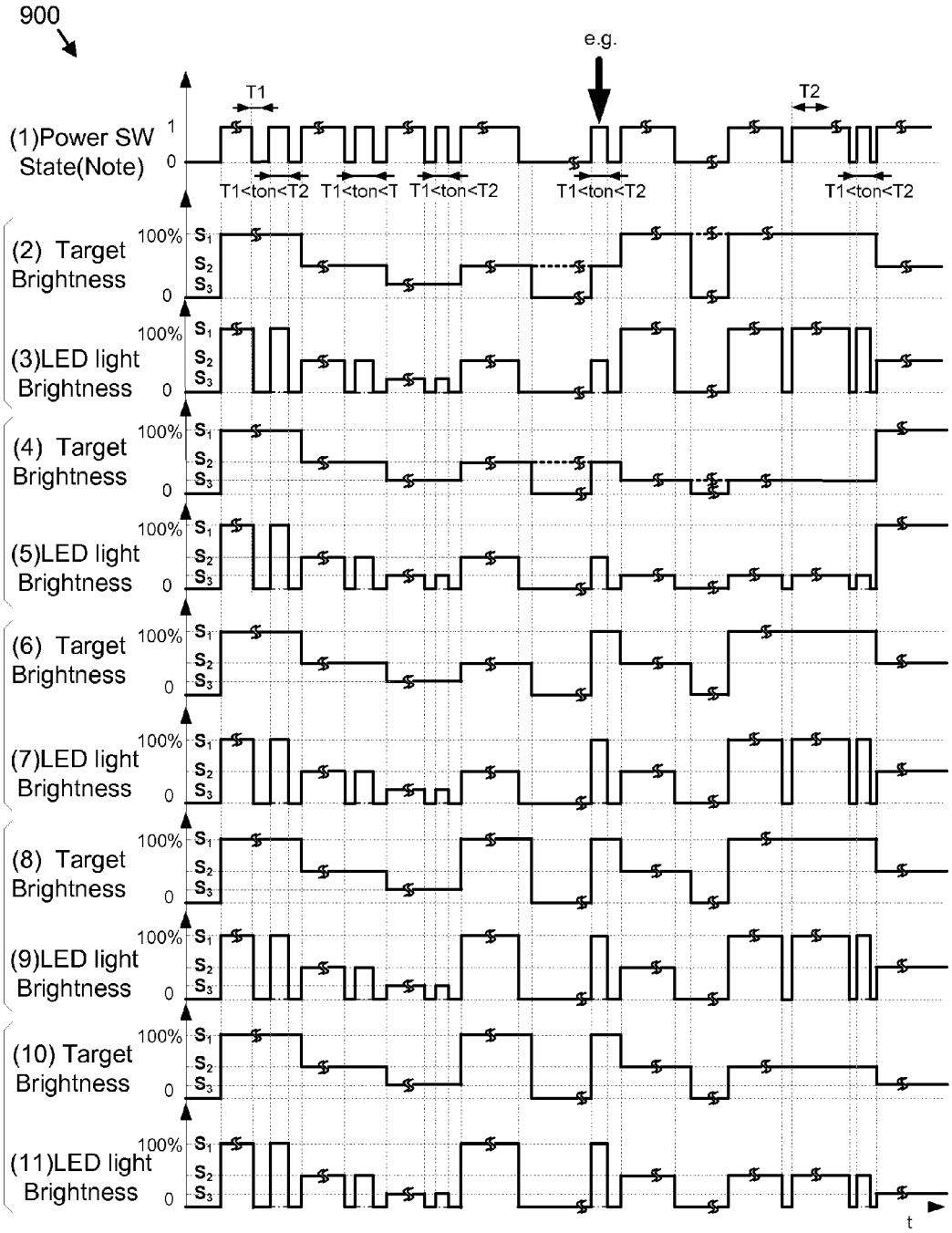
FIG. 9 is a time chart illustrating one embodiment of exemplary LED light dimming operations with the digital control scheme in a third form in accordance with the present invention.

FIG. 9 is a time chart 900 illustrating one embodiment of exemplary LED light dimming operations with the digital control scheme in a third form in accordance with the present invention. The description of FIG. 9 refers to elements of FIGS. 1-8, like numbers referring to like elements. As depicted, the power-on time duration ton is the time duration between T1 and T2 (T1<ton<T2) during which the power switch 111 is turned on and remains on. T1 and T2 are the same time constant as defined in the description of FIGS. 5 and 6. T1 needs to be far smaller than the half cycle time of the power supply. For a 50 Hz power frequency, for example, T1 should be smaller than 1 ms, so as to obtain a more accurate dimming effect; they cannot be too small, however, otherwise interference rejectability is sacrificed. A suitable range for T1 is 400 μs to 1 ms. The microcontroller 411 measures and checks ton to determine if it is within the range of T1 to T2. Typically, following a power on operation by the power switch 111, the brightness of the LED light 113 is adjusted from Sx to Sx+1, where x may be 1, 2, . . . , n and n may be any number. However, if ton is greater than T2 or smaller than T1, the target brightness does not change. When the power-on time duration ton is rather small, the actual brightness output of the LED light 113 cannot catch up with the target brightness. As shown in FIG. 9, when ton lies between T1 and T2, the actual waveform of the LED light 113 brightness is shown as a waveform confined in between a dot-dashed line area and a solid line area, possibly resulting from a rush.

If the cyclic pattern depicted in FIG. 8 is followed, then following a series of turned-on operations of the power switch 111 as discussed above, the target brightness changes from S1 to S2 to . . . Sn, then progressively back to S1 from Sn−1. After a long turned-off operation of the power switch 111, the dimming and control circuit 215 is reset, and the target brightness level is set to zero. At the next power-on time when the power switch 111 is turned on (shown with a downward arrow, for example), the brightness of the LED light 113 may restore to the last brightness level or to S1, depending on whether a power-off memory 421 or 451 is available or not. There are three different ways to control dimming of the LED light 113 based on the target brightness setting:

a. restoring the last target brightness level if said power-off memory is available, and furthermore, if both the previous brightness level (in terms of the LED array current) and the direction of change (up for example) leading to that level were saved, also increasing the target brightness to the next higher level following a subsequent brief turned-off operation of the power switch 111 followed by a turned-on operation of said switch (also shown in FIG. 6), as illustrated at (2) with dashed lines for the target brightness and (3) for the brightness of the LED light 113;

b. restoring the last target brightness level if said power-off memory only saves the last target brightness level, as illustrated at (4) with dashed lines for the target brightness and (5) for the brightness of the LED light 113; and c. restoring the initial target brightness setting of S1 if no said power-off memory is available, as illustrated at (6) for the target brightness and (7) for the brightness of the LED light 113.

If the cyclic pattern depicted in FIG. 7 is followed, then following a series of turned-on operations of the power switch 111 as discussed above, the target brightness changes from S1 to S2 to . . . Sn, then directly back to S1. After a long turned-off operation of the power switch 111, the dimming and control circuit 215 is reset, and the target brightness level is set to zero. At the next power-on time when the power switch 111 is turned on (shown with a downward arrow), the brightness of the LED light 113 may restore to S1 or the last brightness level, depending on whether a power-off memory 421 or 451 is unavailable or available. There are two different ways to control dimming of the LED light 113 based on the target brightness setting:

a. restoring the initial target brightness setting of S1 if said power-off memory is unavailable, as illustrated at (8) for the target brightness and (9) for the brightness of the LED light 113; and b. restoring the last target brightness level if said power-off memory is available, as illustrated at (10) for the target brightness and (11) for the brightness of the LED light 113.

Figure 10:
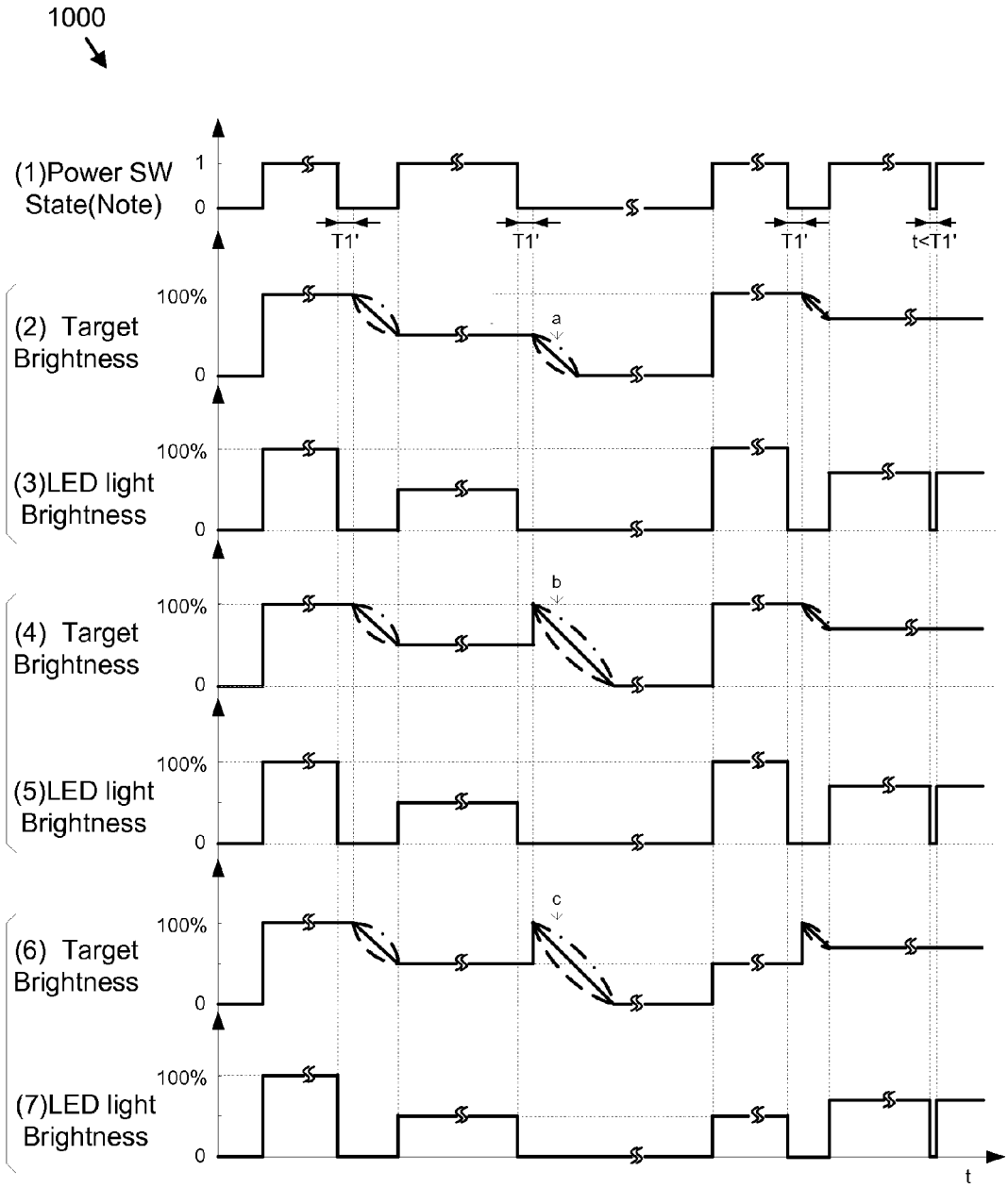
FIG. 10 is a time chart illustrating one embodiment of exemplary LED light dimming operations with an analog control scheme in a first form in accordance with the present invention.

In the cases listed above in which a memory component is available, following a reset of the dimming and control circuit 215, the target brightness is not limited to the setting of zero—it may be any level. Furthermore, the target brightness is not limited to "remaining the same"—it can change, in a pattern after any shape or digitized form. The time chart 900 illustrates the LED light 113 dimming operations occurring subsequent to a series of turned-on operations of the power switch 111 in the third form of the digital control scheme, using power-on time duration ton as a dimming signal FIG. 10 is a time chart 1000 illustrating one embodiment of exemplary LED light dimming operations with an analog control scheme in a first form in accordance with the present invention. The description of FIG. 10 refers to elements of FIGS. 1-9, like numbers referring to like elements. With the analog scheme, the dimmer 112 included in the power switch 111 also comes to play. Unlike the digital scheme, the target brightness does not have discrete levels; the brightness change (dimming) is continuous and gradual. With this analog scheme, when the power-off time duration toff resulting from a turned-off operation of the power switch 111 is smaller than T1', a time constant on the order of a small number of milliseconds, the target brightness for the LED light 113 is unchanged. When toff is greater than T1', the target brightness gradually changes during toff after a T1' time duration along a sloping line (surrounded by a dot-dashed curve) as shown. In a certain embodiment, after the target brightness reaches a preset (desired) target brightness level such as based on operations of the dimmer 112, the power switch 111 is turned on, and the target brightness remains unchanged afterwards. When the brightness of the LED light 113 reaches the level of a preset target brightness, a subsequent turning-off operation of the power switch 111 causes the target brightness to be gradually adjusted. There are three ways to control dimming of the LED light 113, as follows:

a. adjusting the target brightness from the present brightness level down to zero during toff, so that at the next power-on time, the target brightness is set to the initial (full brightness) level, as illustrated at (2), and that the brightness of the LED light 113 follows suit, as illustrated at (3);

b. adjusting the target brightness from the initial brightness level down to zero during toff, so that at the next power-on time, the target brightness is set to the initial brightness level, as illustrated at (4), and that the brightness of the LED light 113 follows suit, as illustrated at (5); and c. adjusting the target brightness from the initial brightness level down to zero during toff, so that at the next power-on time, the target brightness is set to the last brightness level, as illustrated at (6), and that the brightness of the LED light 113 follows suit, as illustrated at (7), assuming the availability of a power-off memory 421 or 451.

Note that the setting of the target brightness indicated above is not limited to the initial or the last brightness level; it may be any brightness level. The initial brightness level is not limited to 100% as illustrated; during toff, the target brightness changes may follow any trajectory other than what is shown. After the dimming and control circuit 215 is reset, the setting of the target brightness is not limited to zero—it may be set to any level, and where the target brightness is said to remain unchanged, it may change in any of a variety of ways. The time chart 1000 illustrates the LED light 113 dimming operations with the analog control scheme in the first form.

Figure 11:
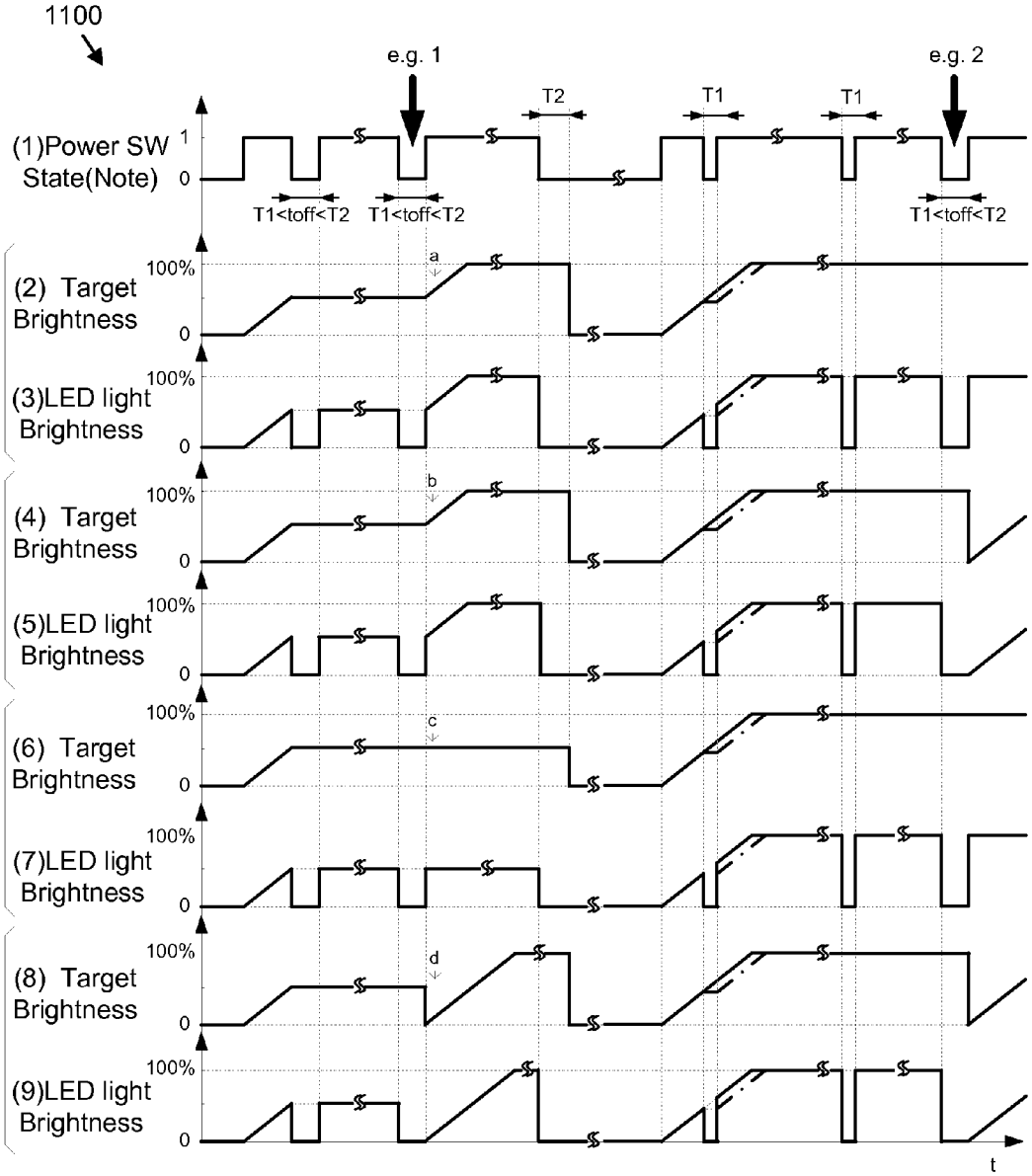
FIG. 11 is a time chart illustrating one embodiment of exemplary LED light dimming operations with the analog control scheme in a second form in accordance with the present invention.

FIG. 11 is a time chart 1100 illustrating one embodiment of exemplary LED light dimming operations with the analog control scheme in a second form in accordance with the present invention. The description of FIG. 11 refers to elements of FIGS. 1-10, like numbers referring to like elements. The dimming and control circuit 215 operates in two modes in the second form of the analog control scheme. In mode 1, the target brightness following a turned-on operation of the power switch 111 changes gradually. In mode 2, the target brightness following a turned-on operation of the power switch 111 remains constant.

Like operations discussed in the description of FIG. 5, the power-off time duration toff required for following operations is in the range of T1 to T2, where T1 and T2 are the same time constants as in FIG. 5. If the power-off time duration toff is greater than T2, the dimming and control circuit 215 is reset and the target brightness is set to the initial brightness level. Afterwards, at the next power-on time, if said circuit operates in mode 1, the target brightness gradually changes. In one embodiment, when the target brightness reaches a preset desired brightness level, the power switch 111 inputs an "effective mode change" signal, and in response to said signal, the dimming and control circuit 215 enters mode 2, and the target brightness remains at the same level. Note that during a power-on time, when the power switch 111 is turned off briefly and then turned back on and the power-off time duration toff is smaller than T2 and greater than T1, said effective mode change signal occurs (i.e. T1<toff<T2<t0).

Time duration t0 is the normal operating time duration of the dimming and control circuit 215 during power off. The time duration t0 is related to the output electric capacity and output current of said circuit. The larger the output electric capacity, the longer said operating time duration; the smaller output current, the longer said operating time duration. In general, provision of output electric capacity is based on a hold-on time required to keep the LED lighting system 100 operating normally in a full load condition for the time duration t0 following the power shutoff. The time duration t0 is typically specified in milliseconds. T2 time is smaller than t0; in some applications, such as in the LED lighting system 100, if t0 is 500 ms, for example, then T2 may be chosen to be 300 ms. T1 may be a small fraction of the half cycle time; in a 50 Hz power system, for example, T1 should be smaller than 1 ms, to obtain a fair dimming accuracy. However, T1 may not be too small, otherwise interference rejectability is sacrificed. A suitable range for T1 may be 400 microseconds to 1 millisecond, and T1 is supposed to be smaller than T2.

If the power-off time duration toff is greater than T2, the dimming and control circuit 215 is reset, and the target brightness is set to the initial brightness. If toff is smaller than T1, then the dimming and control circuit 215 ignores toff, as if no power-off operation took place. If the dimming and control circuit 215 operates in mode 1, the target brightness may continue to change after a power-off operation as shown with a solid sloping line, or it may remain the same as shown with a dot-dashed line. If the dimming and control circuit 215 operates in mode 2, the target brightness remains unchanged.

When the dimming and control circuit 215 operates in mode 1, if there is no effective mode change signal from the power switch 111, after the target brightness reaches a certain fixed maximum brightness level (such as 100% as shown although it is not limited to that), said circuit enters mode 2 automatically, and the target brightness remains at that level, without any change. When the brightness of the LED light 113 remains at a preset target brightness level, that is, the dimming and control circuit 215 operates in mode 2, and if the power switch 111 inputs an effective mode change signal (an occurrence of T1<toff<T2; see examples 1 and 2 shown with downward arrows), then there are four ways to control dimming by the dimming and control circuit 215, as follows:

a. either entering mode 1 and having the target brightness start changing from the current brightness level if the current target brightness is below the fixed maximum brightness level (example 1), or remaining in mode 2 and having no change to the target brightness if the current target brightness is at the fixed maximum brightness level (example 2), and during a power-off time duration toff that is greater than T2, resetting the dimming and control circuit 215 and setting the target brightness to the initial brightness level (such as zero as shown although not limited to that), so that at the next power-on time the target brightness starts changing from the initial brightness level. The waveforms of the target brightness and the brightness of the LED light 113 are illustrated at (2) and (3), respectively;

b. either entering mode 1 and having the target brightness start changing from the current brightness level if the current target brightness is below the fixed maximum brightness level (example 1), or entering mode 1 and having the target brightness change from the initial brightness level if the current target brightness is at the fixed maximum level (example 2), and during a power-off time duration toff that is greater than T2, resetting the dimming and control circuit 215 and setting the target brightness to the initial brightness level, so that at the next power-on time the target brightness starts changing from the initial brightness level. The waveforms of the target brightness and the brightness of the LED light 113 are illustrated at (4) and (5), respectively;

c. remaining in mode 2 (example 1) until the power-off time duration toff is greater than T2, when the dimming and control circuit 215 is reset and the target brightness is set to initial brightness level, and entering mode 1 at the next power-on time and having the target brightness change. The waveforms of the target brightness and the brightness of the LED light 113 brightness are illustrated at (6) and (7), respectively; and d. entering mode 1 regardless of the current target brightness level (example 1), and during a power-off time duration toff that is greater than T2, resetting the dimming and control circuit 215 and setting the target brightness to the initial brightness level, so that at the next power-on time the target brightness starts changing from the initial brightness level. The waveforms of the target brightness and the LED light 113 brightness are illustrated at (8) and (9), respectively.

Note that the initial brightness level of the target brightness is not limited to zero as depicted. After the dimming and control circuit 215 is rest, the setting of the target brightness is not limited to initial brightness level as indicated above; it may be any brightness level. Where the target brightness is said to remain unchanged, it may change in any of a variety of ways. At power-on time following the reset of said circuit, the target brightness is not limited to changing from the initial brightness level; it may change from any brightness level. The target brightness changes may follow any trajectory other than what is shown. The time chart 1100 illustrates the LED light 113 dimming operations with the analog control scheme in the second form.

Figure 12:
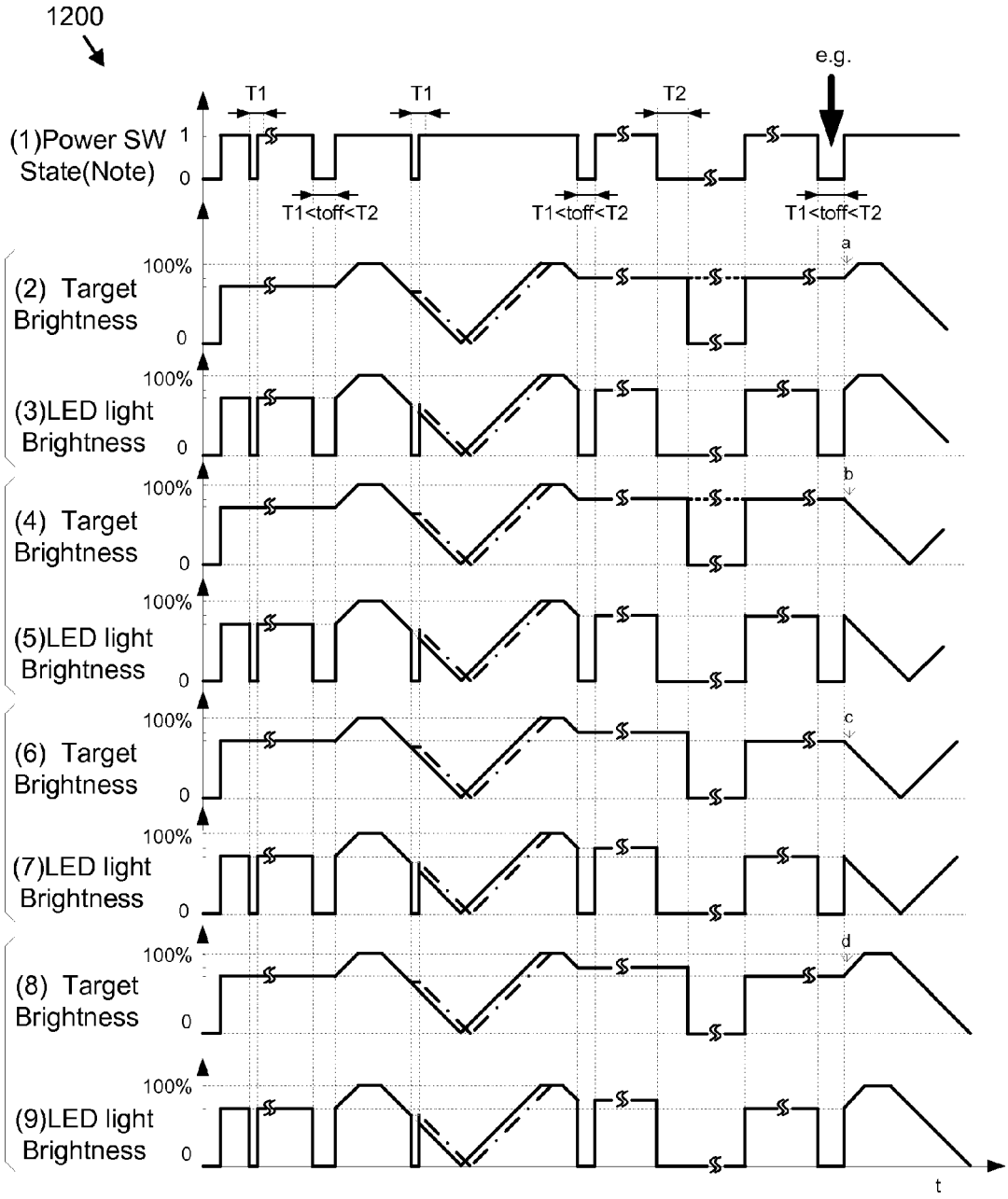
FIG. 12 is a time chart illustrating one embodiment of exemplary LED light dimming operations with the analog control scheme in a third form in accordance with the present invention.

FIG. 12 is a time chart 1200 illustrating one embodiment of exemplary LED light dimming operations with the analog control scheme in a third form in accordance with the present invention. The description of FIG. 12 refers to elements of FIGS. 1-11, like numbers referring to like elements. The dimming and control circuit 215 operates in two modes in the third form of the analog control scheme. In mode 1, the target brightness following a turned-on operation of the power switch 111 changes gradually. In mode 2, the target brightness following a turned-on operation of the power switch 111 remains constant.

Like operations discussed in the description of FIG. 5, the power-off time duration toff required for following described operations is in the range of T1 to T2, where T1 and T2 are two time constants, as defined in the description of FIG. 5. If the power-off time duration toff is greater than T2, the dimming and control circuit 215 is reset, and at the next power-on time, the dimming and control circuit 215 operates in mode 2, and the target brightness remains at a preset brightness level without any change. During a mode 2 operation, when the power switch 111 inputs an effective mode change signal, the dimming and control circuit 215 enters mode 1, and the target brightness changes gradually at the next power-on time. While operating in mode 1, the target brightness changes gradually at a power-on time; when the target brightness reaches a desired brightness level, the power switch 111 inputs an effective mode change signal, the dimming and control circuit 215 enters mode 2, and the target brightness remains at the desired brightness level.

During a power-on time, the power switch 111 may be turned off briefly and then turned on, if the power-off time duration toff is smaller than T2 and greater than T1, the power switch 111 essentially inputs an effective mode change signal. If toff is greater than T2, the dimming and control circuit 215 is reset after T2 time, the target brightness is set to zero. If toff is smaller than T1, that turned-off operation is ignored, and if the dimming and control circuit 215 operates in mode 1, the target brightness continues to change (note that following a turned-off operation, the target brightness may continue to change as illustrated with a solid line or may not change as illustrated with a dot-dashed line).

While the dimming and control circuit 215 operates in mode 1, if the power switch 111 does not input an effective mode change signal, the target brightness keeps changing. When the power-off time duration is greater than T2, the dimming and control circuit 215 is reset, and at the next power-on time, the target brightness will be the target brightness at the last power-on time, and the dimming and control circuit 215 will operate in mode 2, and said circuit may or may not have memory of the last target brightness and may or may not have memory of the last target brightness change direction. While the dimming and control circuit 215 operates in mode 2, the power switch 111 inputs an effective mode change signal (an example shown with a downward arrow), which causes said circuit to enter mode 1 and the target brightness to change. There are four ways the dimming and control circuit 215 controls dimming:

a. setting the target brightness change direction to be the change direction toward the initial target brightness since there is memory of the last target brightness, but not the last target brightness change direction. The waveforms of the target brightness and the brightness of the LED light 113 are illustrated at (2) and (3), respectively;
b. setting the target brightness change direction to be the change direction of the last stabilised target brightness since there are memories of the last target brightness and the last target brightness change direction. The waveforms of the target brightness and the brightness of the LED light 113 are illustrated at (4) and (5), respectively;
c. setting the target brightness change direction to be the change direction of the last target brightness since there is no memory of last target brightness, but there is memory of the last target brightness change direction. The waveforms of the target brightness and the brightness of the LED light 113 are illustrated at (6) and (7), respectively; and
d. setting the target brightness change direction to be the change direction of the initial target brightness since there is no memory of target brightness at all. The waveforms of the target brightness and the brightness of the LED light 113 are illustrated at (8) and (9), respectively.

Note that the initial brightness level of the target brightness is not limited to what is depicted. After the dimming and control circuit 215 is reset, the setting of the target brightness is not limited to the initial brightness level as indicated above; it may be any brightness level. Where the target brightness is said to remain unchanged, it may change in any of a variety of ways. When the power-off time duration toff is greater than T2, the dimming and control circuit 215 is reset, and said circuit enters mode 2, but the setting of the target brightness is not limited to the initial brightness level or the last target brightness—it may be any brightness level. While the dimming and control circuit 215 is in mode 2, if the power switch 111 inputs an effective mode change signal, said circuit enters mode 1, and the target brightness starts to change. The change direction of the target brightness is not limited to that of the initial target brightness or that of the last target brightness as indicated above—it may be any direction. While the dimming and control circuit 215 is in mode 1, if the power-off time duration toff is greater than T2, said circuit is reset, and afterwards at the next power-on time, said circuit is not limited to operating in mode 2—it may operate in mode 1. The target brightness changes may follow any trajectory other than what is shown. The time chart 1200 illustrates one embodiment of the LED light 113 dimming operations with the analog control scheme in the third form.

Figure 13:
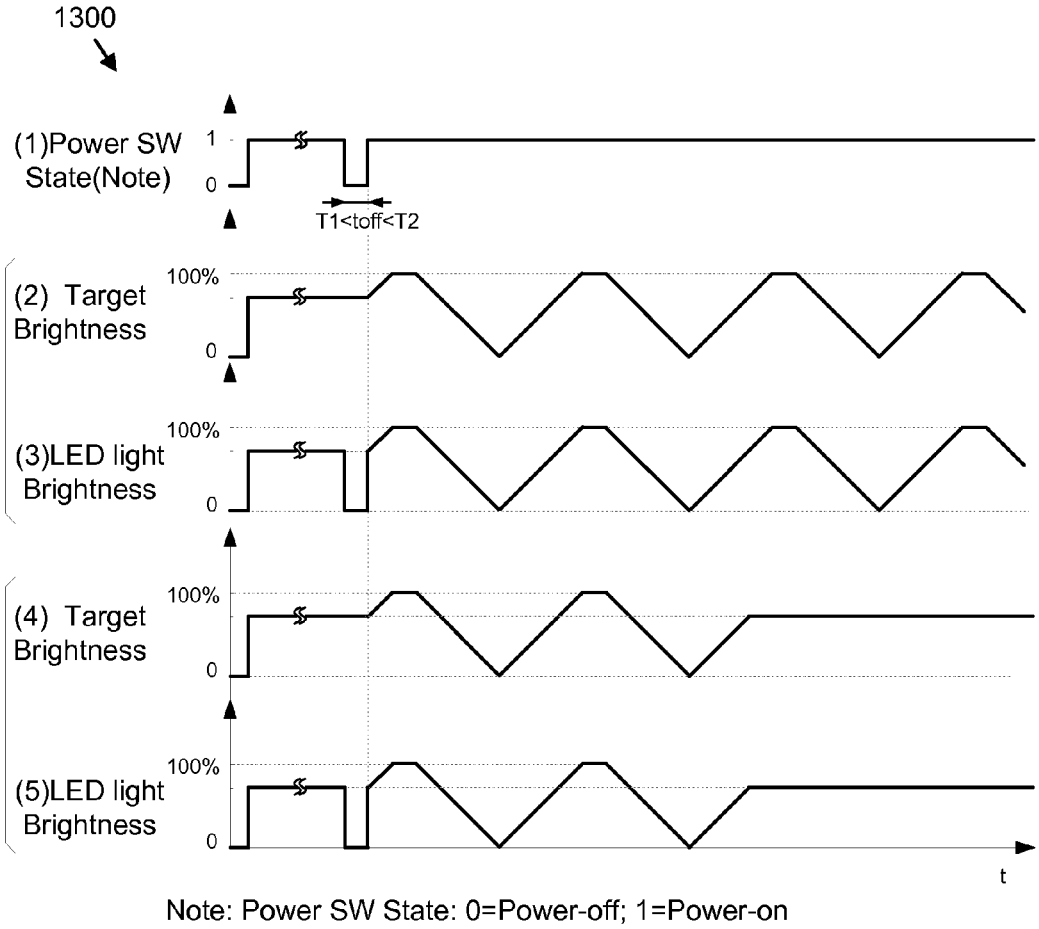
FIG. 13 is a time chart illustrating one alternate embodiment of exemplary LED light dimming operations with the analog control scheme in the third form in accordance with the present invention.

FIG. 13 is a time chart 1300 illustrating one alternate embodiment of exemplary LED light dimming operations with the analog control scheme in the third form in accordance with the present invention. The description of FIG. 13 refers to elements of FIGS. 1-12, like numbers referring to like elements. The target brightness is at an initial brightness level (such as 0%). After the power switch 111 is turned on, the dimming and control circuit 215 operates in mode 2, and the target brightness starting at a certain brightness level remains constant until a power-off time duration toff (T1<toff<T2) occurs, which causes said circuit to enter mode 1. Based on the description of FIG. 12, two different ways of controlling dimming by the dimming and control circuit 215 as shown are:

a. letting the target brightness gradually change while the dimming and control circuit 215 operates in mode 1, and continuing the target brightness change repeatedly within the range of 100% and 0% as long as the power switch 111 does not input a new effective mode change signal, as illustrated at (2) for the target brightness and at (3) for the brightness of the LED light 113; and
b. letting the target brightness gradually change while the dimming and control circuit 215 operates in mode 1, and, as long as the power switch 111 does not input a new effective mode change signal, continuing the target brightness change within the range of 100% and 0% for N cycles, for a certain period of time, or to a certain brightness level, as illustrated at (4) for the target brightness and at (5) for the brightness of the LED light 113, where N=2 (although N may be any number). The time chart illustrates an alternate embodiment of the LED light 113 dimming operations with the analog control scheme in the third form.

Figure 14:
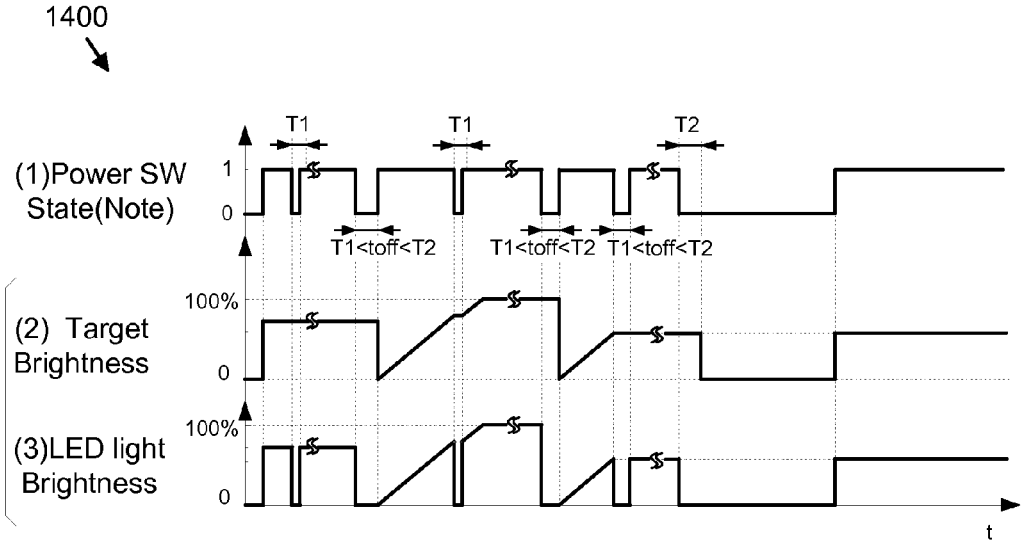
FIG. 14 is a time chart illustrating one embodiment of exemplary LED light dimming operations with the analog control scheme in a fourth form in accordance with the present invention.

FIG. 14 is a time chart 1400 illustrating one embodiment of exemplary LED light dimming operations with the analog control scheme in a fourth form in accordance with the present invention. The description of FIG. 14 refers to elements of FIGS. 1-13, like numbers referring to like elements. The fourth form herein is obtained by combining FIGS. 12 and 13. The target brightness is at an initial brightness level (such as 0%). After the power switch 111 is turned on, the dimming and control circuit 215 operates in mode 2, and the target brightness starting at a certain brightness level remains constant until a power-off time duration toff (T1<toff<T2) occurs, which causes said circuit to enter mode 1.

While the dimming and control circuit 215 operates in mode 1, the target brightness gradually changes (rises). When the target brightness rises to 100%, the dimming and control circuit 215 enters mode 2, and the target brightness remains constant. As the power switch 111 next inputs an effective mode change signal (T1<toff<T2), the dimming and control circuit 215 enters mode 1, and the target brightness starts to change (rises) from zero until it reaches a desired brightness level at which time the power switch 111 inputs an effective mode change signal, causing mode 2 to be entered. Then the target brightness maintains the desired brightness level. When the power-off time duration toff is greater than T2, the dimming and control circuit 215 is reset, and at the next power-on time, said circuit enters mode 2, and the target brightness maintains the last brightness level (when a power-off memory 421 or 451 is available). Operations of this sequence are illustrated at (2) and (3) for the target brightness and the brightness of the LED light 113, respectively. The time chart 1400 illustrates the LED light 113 dimming operations with the analog control scheme in the fourth form.

Figure 15:
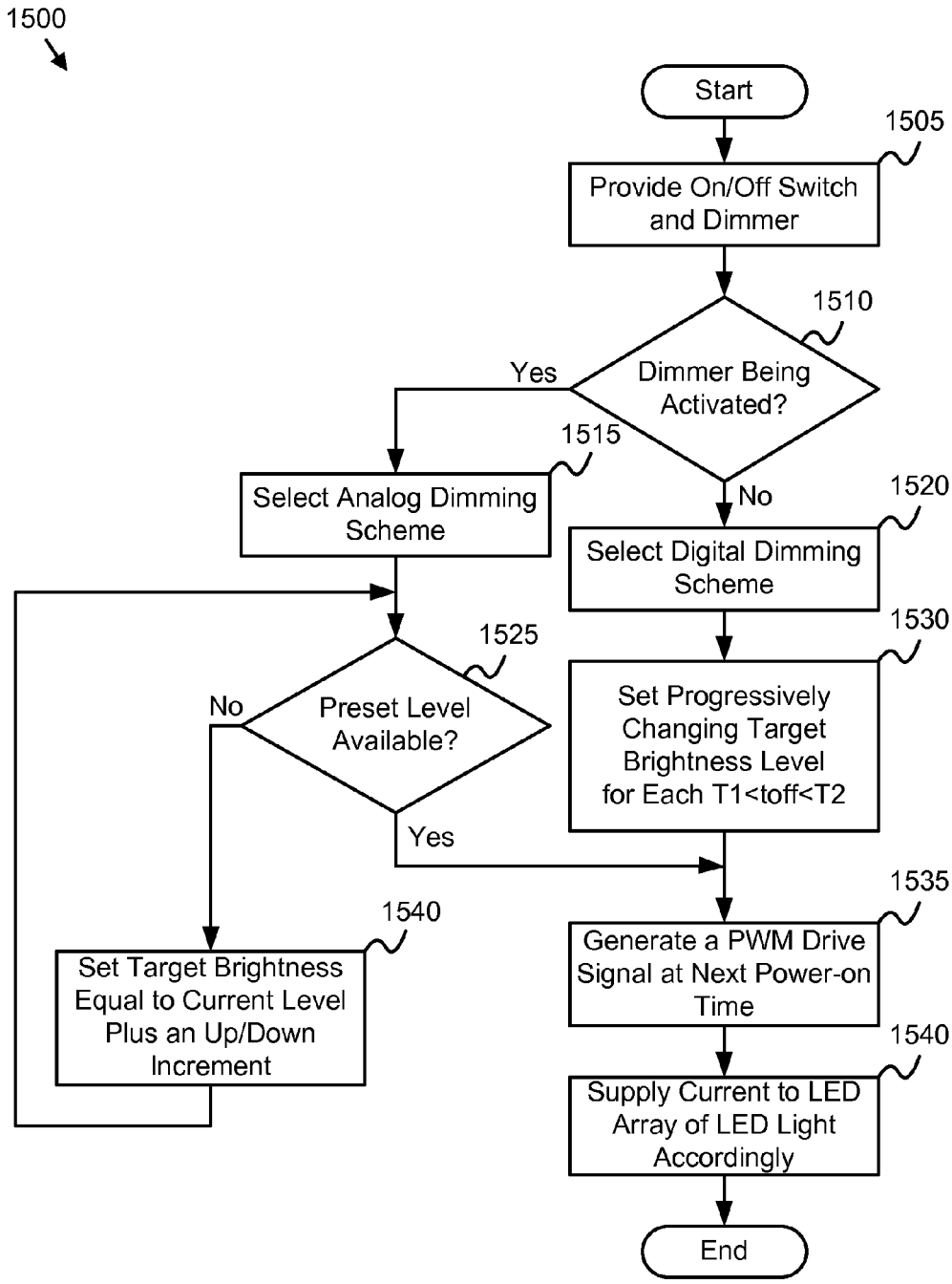
FIG. 15 is a schematic flow chart diagram illustrating one embodiment of a method for LED light dimming in accordance with the present invention.

FIG. 15 is a schematic flow chart diagram illustrating one embodiment of a method 1500 for LED light dimming in accordance with the present invention. The description of FIG. 15 refers to elements of FIGS. 1-14, like numbers referring to like elements. The method 1500 begins by providing 1505 an on/off switch 110 and a dimmer 112 both of which are included in the power switch 111 assembly. The method proceeds to determine 1510 whether the dimmer 112 is being activated. If the dimmer 112 is not being activated, the microcontroller 411 shown in FIG. 4*a*, for example, selects a digital dimming scheme as illustrated in FIGS. 5-9. The microcontroller 411 will generate 1530 a progressively decreasing or increasing target brightness level based on the current target brightness level each time a momentary turned-off operation of the on/off switch 110 of time duration T1<toff<T2 occurs, where T1 and T2 are two time constants, and toff is a variable, representing power-off time duration, as discussed in the description of FIG. 5. This range is referred to as transitory duration in certain embodiments.

If the dimmer 112 is being activated, the microcontroller will select 1515 an analog dimming scheme as illustrated in FIGS. 10-14. The microcontroller 411 further determines 1525 whether the user has selected a preset level for the target brightness. If no preset level is selected, the microcontroller 411 will generate 1540 a new target brightness level by adding a predetermined increment to the current target brightness level in the direction of level advancing or declining, depending on whether the up switch 112*a* or the down switch 112*b* is being depressed. This process repeats until a preset level is established, that is, a desired target brightness signal is generated.

Once a target brightness level is set, whether it is set based on a digital control scheme or an analog control scheme, at the next power-on time, the dimming and control circuit 215*a* shown in FIG. 4*a* will generate 1535 a drive signal as an output of the EA and driver 424. In response to this signal, the power switching circuit 214*a* will supply 1540 current to the LED array 241-24*m* of the LED light 113*a* for it to output a corresponding brightness level. Thus, the method 1500 accomplishes dimming control of the LED light 113*a*.

The present invention provides a system for accomplishing dimming of an LED light in a typical LED lighting installation by use of a versatile, efficient, user-friendly and energy-saving method. The benefits derivable include increased power factor, reduced harmonic distortion, and minimal electromagnetic interference. The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system comprising:

an LED light comprising one or more LEDs;

a power switch comprising second and third switches that are connected to an alternating current ("AC") power source and are biased to remain in a neutral position if not activated, wherein said second and third switches are each connected in series with said AC power line, and wherein activating either of said second and said third switch provides sequential pulses to a lighting control device and either of said second or third switch is activated when a power on/off switch is in one of a turned-on and a turn-off state;

a dimming control module electrically connectable to the LED light configured to light up and dim the LED light according to a target brightness setting by generating a reference current signal in response to said target brightness setting and driving a drive circuit with a drive signal that is a difference of said reference current signal and a drive circuit output current;

said AC power source configured to supply electric power to the dimming control module; and said lighting control device disposed between said power source and the dimming control module and operated by a user, the lighting control device comprising a power on/off switch and a dimmer, the power on/off switch configured to make and break electrical connection between said power source and the dimming control module, and the dimmer configured to generate a target brightness setting signal, representative of a desired target brightness level for the LED light to attain;

wherein the dimming control module is further configured to set a plurality of progressively and gradually varying target brightness levels leading to attainment of a desired target brightness level by the LED light in response to a user input selected from the group consisting of a series of turned-off operations of the power on/off switch of transitory duration and operations of the dimmer leading to generation of said target brightness setting signal.

2. The system of claim 1, wherein the dimming control module is further configured to generate said drive signal as a pulse width modulated signal based on a selected target brightness level.

3. The system of claim 2, wherein the dimming control module supplies current to said LEDs in response to said drive signal while the power on/off switch is turned on.

4. The system of claim 1, wherein said transitory duration is in the range of 400 microseconds to 300 milliseconds on condition of a hold-on time of 500 milliseconds required of the dimming control module to sustain normal activities thereof subsequent to a turned-off operation of the power on/off switch.

5. The system of claim 4, wherein the LED light target brightness setting does not change upon turned-on and turned-off operations of the power on/off switch of more than said transitory duration.

6. The system of claim 1, wherein the dimming control module receives and saves said target brightness setting signal, so that the desired target brightness level of the LED light is available at the next power-on time.

7. The system of claim 1, wherein the dimming control module changes from one target brightness setting to another target brightness setting in response to turned-on and/or turned-off operations of the power on/off switch and continues to operate from the new target brightness setting.

8. The system of claim 1, wherein analog and digital dimming control schemes are usable by the dimming control module.

9. The system of claim 8, wherein based on the analog control scheme, the dimming control module has two modes of operation to choose from upon a turned-on operation of the power on/off switch, wherein mode 1 allows a target brightness setting to change gradually, and mode 2 does not allow any target brightness setting change.

10. The system of claim 9, wherein the mode of operation is changeable from one to the other in response to a turned-on and/or turned-off operation of the power on/off switch.

11. The system of claim 9, wherein the dimming control module is operable in one mode for a period of time before changing to the other mode.

12. The system of claim 1, wherein it takes a fixed amount of time for the brightness outputted by the LED light to reach the target brightness level subsequent to a turned-on operation of the power on/off switch.

13. A method for dimming an LED light comprising:

providing a user-operated lighting control device comprising a power switch comprising second and third switches that are connected to an alternating current ("AC") power source and are biased to remain in a neutral position if not activated, wherein said second and third switches are each connected in series with said AC power line, and wherein activating either of said second and said third switch provides sequential pulses to a lighting control device and either of said second or third switch is activated when a power on/off switch is in one of a turned-on and a turn-off state and a dimmer, the power on/off switch configured to turn on and off an AC power to the LED light comprising one or more LEDs, and the dimmer configured to generate a target brightness setting signal, representative of a desired target brightness level for the LED light to attain, by generating a reference current signal in response to said target brightness setting signal;

driving a drive circuit with a drive signal that is a difference of said reference current signal and a drive circuit output current;

receiving the AC power through the power on/off switch by the LED light;

setting a plurality of progressively and gradually varying target brightness levels leading to attainment of a desired target brightness level by the LED light in response to a user input selected from the group consisting of a series of turned-off operations of the power on/off switch of transitory duration and operations of the dimmer leading to generation of said target brightness setting signal;

and supplying current to said LEDs from said drive circuit in response to said drive signal during the reception of the AC power.

14. The method of claim 13, wherein said transitory duration is in the range of 400 microseconds to 300 milliseconds on condition of a hold-on time of 500 milliseconds required to sustain normal dimming control activities subsequent to a turned-off operation of the power on/off switch.

15. The method of claim 13, wherein analog and digital dimming control schemes are usable.

16. The method of claim 13, wherein said plurality of target brightness levels set in response to a series of turned-off operation of the power on/off switch of transitory duration involve N progressively increasing target brightness levels in a repeatable cyclic pattern, where N is a predefined number.

17. The method of claim 13, wherein said plurality of target brightness levels set in response to a series of turned-off operation of the power on/off switch of transitory duration involve N progressively decreasing target brightness levels in a repeatable cyclic pattern, where N is a predefined number.

18. The method of claim 13, a target brightness level for the LED light output is in the range of 0% to 100%.

19. The method of claim 13, wherein setting a target brightness level makes uses of a memory of a latest target brightness level and/or a latest target brightness change direction.

20. The method of claim 19, wherein in response to a target brightness level reset initiate subsequent to a power-off operation of more than transitory duration, the target brightness level rises from 0% to a level selected from the group consisting of the maximum allowed brightness level and the last brightness level.

* * * * *